US011078657B2

(12) United States Patent
Muellenbach

(10) Patent No.: US 11,078,657 B2
(45) Date of Patent: Aug. 3, 2021

(54) FLOOR-MOUNTED TOILET WITH ADJUSTABLE TRAPWAY FOR CONNECTION TO WALL CARRIER

(71) Applicant: Kohler Co., Kohler, WI (US)

(72) Inventor: Keith Muellenbach, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 15/848,317

(22) Filed: Dec. 20, 2017

(65) Prior Publication Data

US 2018/0216334 A1 Aug. 2, 2018

Related U.S. Application Data

(60) Provisional application No. 62/452,488, filed on Jan. 31, 2017, provisional application No. 62/452,485, filed on Jan. 31, 2017.

(51) Int. Cl.

| | |
|---|---|
| ***E03D 11/17*** | (2006.01) |
| ***E03D 11/12*** | (2006.01) |
| ***E03D 11/16*** | (2006.01) |
| ***E03D 11/18*** | (2006.01) |
| *E03D 11/14* | (2006.01) |

(52) U.S. Cl.

CPC ..... *E03D 11/17* (2013.01); *E03D 11/125* (2013.01); *E03D 11/16* (2013.01); *E03D 11/18* (2013.01); *E03D 11/143* (2013.01)

(58) Field of Classification Search

CPC ..... E03D 11/125; E03D 11/14; E03D 11/13; E03D 11/16; E03D 11/18; E03D 11/17; E03D 11/143

USPC ..... 4/252.2, 252.3; 285/56–60

See application file for complete search history.

(56) References Cited

U.S. PATENT DOCUMENTS

| | | | |
|---|---|---|---|
| 2,055,489 | A | 9/1936 | Groeniger |
| 2,212,518 | A | 8/1940 | Groeniger |
| 3,102,274 | A | 9/1963 | Witvrouw |

(Continued)

FOREIGN PATENT DOCUMENTS

| | | |
|---|---|---|
| CN | 1250502 | 4/2000 |
| CN | 201214825 | 4/2009 |

(Continued)

OTHER PUBLICATIONS

EP Official Action dated Nov. 21, 2018; 9 pages.
Chinese Office Action for Chinese Application No. 201810084852.1 dated Apr. 10, 2020.

*Primary Examiner* — Huyen D Le
(74) *Attorney, Agent, or Firm* — Lempia Summerfield Katz LLC

(57) ABSTRACT

A toilet includes a base configured to engage a floor in a bathroom, the base defining a rear wall. The toilet further includes a plurality of openings defined in the rear wall configured to couple the rear wall to at least one of a wall in a bathroom or a wall carrier. The toilet further includes a cavity formed in the rear wall and a bowl defining a sump. The toilet further includes a discharge pipe defining a discharge pipe inlet disposed at the sump and a discharge pipe outlet disposed in the cavity. The toilet further includes a lower trapway having an upper section configured to receive the discharge pipe outlet therein and a lower trapway outlet configured to be fluidly coupled to a wall carrier.

19 Claims, 25 Drawing Sheets

(56) References Cited

U.S. PATENT DOCUMENTS

| | | | | | |
|---|---|---|---|---|---|
| 3,281,867 | A | | 11/1966 | Pope | |
| 3,680,154 | A | * | 8/1972 | Stairs | E03D 11/16 4/420 |
| 3,871,034 | A | * | 3/1975 | Weigel | E03D 11/14 277/609 |
| 4,726,079 | A | * | 2/1988 | Signori | A47K 13/10 4/252.1 |
| 4,967,425 | A | * | 11/1990 | Kawamura | E03D 5/10 4/619 |
| 5,819,326 | A | * | 10/1998 | Kobayashi | B28B 1/261 4/252.1 |
| 6,108,826 | A | | 8/2000 | Hayashi et al. | |
| 6,292,956 | B1 | * | 9/2001 | Kayahara | B28B 1/261 4/420 |

FOREIGN PATENT DOCUMENTS

| | | |
|---|---|---|
| CN | 203821541 | 9/2014 |
| DE | 8316661 | 10/1983 |
| FR | 2910953 | 7/2008 |
| GB | 1113532 | 5/1968 |
| JP | 2010270469 | 12/2010 |
| JP | 2011256707 | 12/2011 |

* cited by examiner

FLOOR-MOUNTED TOILET WITH ADJUSTABLE TRAPWAY FOR CONNECTION TO WALL CARRIER

CROSS-REFERENCE TO RELATED APPLICATIONS

The present application claims the benefit of and priority to U.S. Provisional Patent Application No. 62/452,488, filed Jan. 31, 2017 and U.S. Provisional Patent Application No. 62/452,485, filed Jan. 31, 2017, the entire disclosures of which are incorporated herein by reference.

BACKGROUND

The present application relates generally to the field of toilets with adjustable trapway assemblies. Specifically, the present application relates to trapway assemblies for use with a floor-mounted toilet retrofits for use with wall carriers for wall-mounted toilets.

Wall carriers for commercial wall-mounted toilets may be installed at a range of heights to accommodate various desired bowl heights (e.g., standard height, ADA-approved height, etc.). The height of a given wall carrier is determined when the bathroom is initially plumbed for installation of each wall-mounted toilet.

Floor-mounted toilets may be able to support a larger weight than wall-mounted toilets, and may therefore be more desirable in certain applications (e.g., in hospitals). Conventionally, retrofitting a bathroom from a wall-mounted toilet to a floor-mounted toilet requires opening the wall, removing the wall carrier, cutting open the floor, and re-plumbing the drain to a floor-based position. The wall and floor must then be repaired before installing the floor-mounted toilet bowl.

This current method is very costly and can remove the toilet or entire bathroom from service for a long period of time while work is underway to plumb the floor outlet. Furthermore, if the wall carrier is built completely above the floor, including a waste drain located above the floor, the entire waste drain system needs to be relocated below the floor such that the waste drain is below the toilet outlet for proper draining of the new floor-mounted toilets. It would therefore be advantageous to provide a floor-mounted toilet with a trapway capable of connecting to a wall carrier at different heights.

SUMMARY

One embodiment relates to a toilet, including a base configured to engage a floor in a bathroom, the base defining a rear wall. The toilet further includes a plurality of openings defined in the rear wall configured to couple the rear wall to at least one of a wall in a bathroom or a wall carrier. The toilet further includes a cavity formed in the rear wall and a bowl defining a sump. The toilet further includes a discharge pipe defining a discharge pipe inlet disposed at the sump and a discharge pipe outlet disposed in the cavity. The toilet further includes a lower trapway having an upper section configured to receive the discharge pipe outlet therein and a lower trapway outlet configured to be fluidly coupled to a wall carrier.

Another embodiment relates to a toilet, including a base configured to engage a bathroom floor, the base defining a rear wall. The toilet further includes a plurality of openings defined in the rear wall configured to couple the rear wall to a bathroom wall. The toilet further includes a cavity formed in the rear wall and a bowl defining a sump. The toilet further includes a discharge pipe defining a discharge pipe inlet disposed at the sump and a discharge pipe outlet disposed in the cavity. The toilet further includes a lower trapway configured to fluidly connect the discharge pipe outlet to the wall carrier.

Another embodiment relates to a method of providing a floor-mounted toilet for use with a wall carrier, including providing a lower trapway having an upper section at an upstream end, a lower trapway outlet at a downstream end, and a mounting plate extending outward at the lower trapway outlet. The method further includes positioning the lower trapway outlet proximate a wall carrier and coupling the mounting plate to a bathroom wall. The method further includes providing a floor-mounted toilet with a discharge pipe having a discharge pipe outlet disposed in a cavity formed in a rear wall of the toilet. The method further includes lowering the discharge pipe outlet into the upper section of the lower trapway, and coupling the rear wall of the toilet to the bathroom wall.

DETAILED DESCRIPTION

Referring generally to the FIGURES, a floor-mounted toilet with an adjustable trapway assembly is shown according to an exemplary embodiment. The floor-mounted toilet is configured to replace a conventional wall-mounted toilet to improve the amount of weight the toilet is able to withstand. The floor-mounted toilet may be installed on the same mounting points used to support the wall-mounted toilet. Furthermore, in order to replace wall-mounted toilets installed at various heights, the trapway assembly is adjustable.

Figure 1:
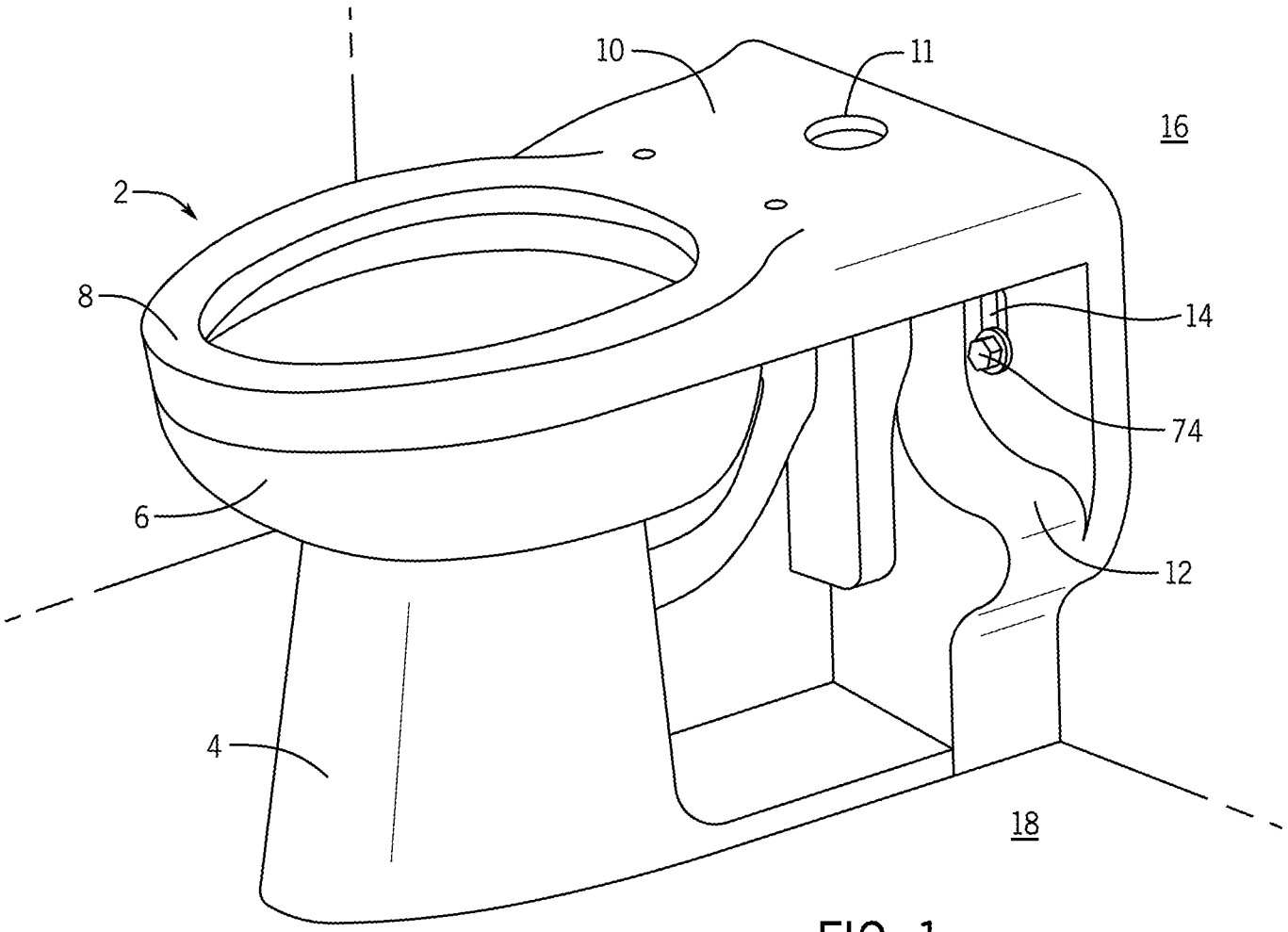
FIG. 1 is a floor-mounted toilet according to an exemplary embodiment.

Referring now to FIG. 1, a floor-mounted (i.e., pedestal) toilet 2 is shown, according to an exemplary embodiment. The toilet 2 includes a base 4 and a bowl 6 having a rim 8 at an upper end thereof. The base 4 is positioned, at least in part, below the bowl 6 and is configured to support a load provided on the bowl 6. An upper surface 10 extends generally rearward from the rim 8 and is configured to support a flush valve and/or a tank (not shown) for supplying water to the bowl 6 from a water source. For example, the upper surface 10 includes an inlet 11 configured to receive water therein from the water source and feed the water to at least one of the bowl 6 and the rim 8. The toilet 2 includes a rear wall 12, which defines a plurality of elongated slots 14 (i.e., holes, openings, etc.) for receiving a fastener therethrough and configured to secure the toilet 2 to a wall 16. As shown in FIG. 1, the base 4 is supported by and joined to a floor 18 (i.e., ground) in a bathroom. Unlike with a wall-mounted toilet, for the toilet 2 in FIG. 1, a load applied to the bowl 6 is distributed to the base 4, rather than just the rear wall 12. In this configuration, the toilet 2 is capable of withstanding a user with a larger weight without risking damage to the connection between the rear wall 12 of the toilet 2 and the wall 16.

Figure 2:
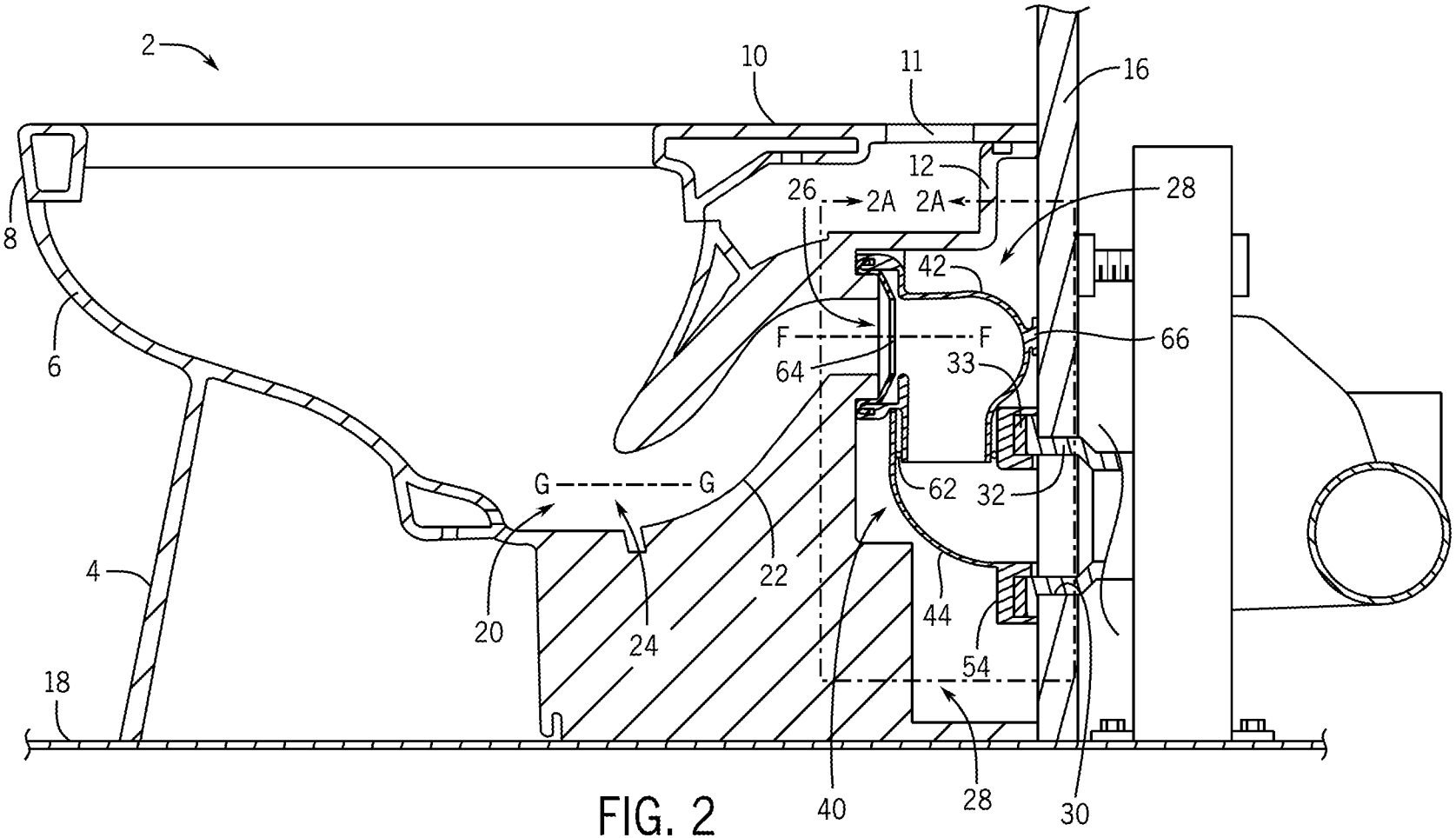
FIG. 2 a cross-sectional view of the toilet of FIG. 1, showing an adjustable trapway assembly according to an exemplary embodiment.
Figure 2A:
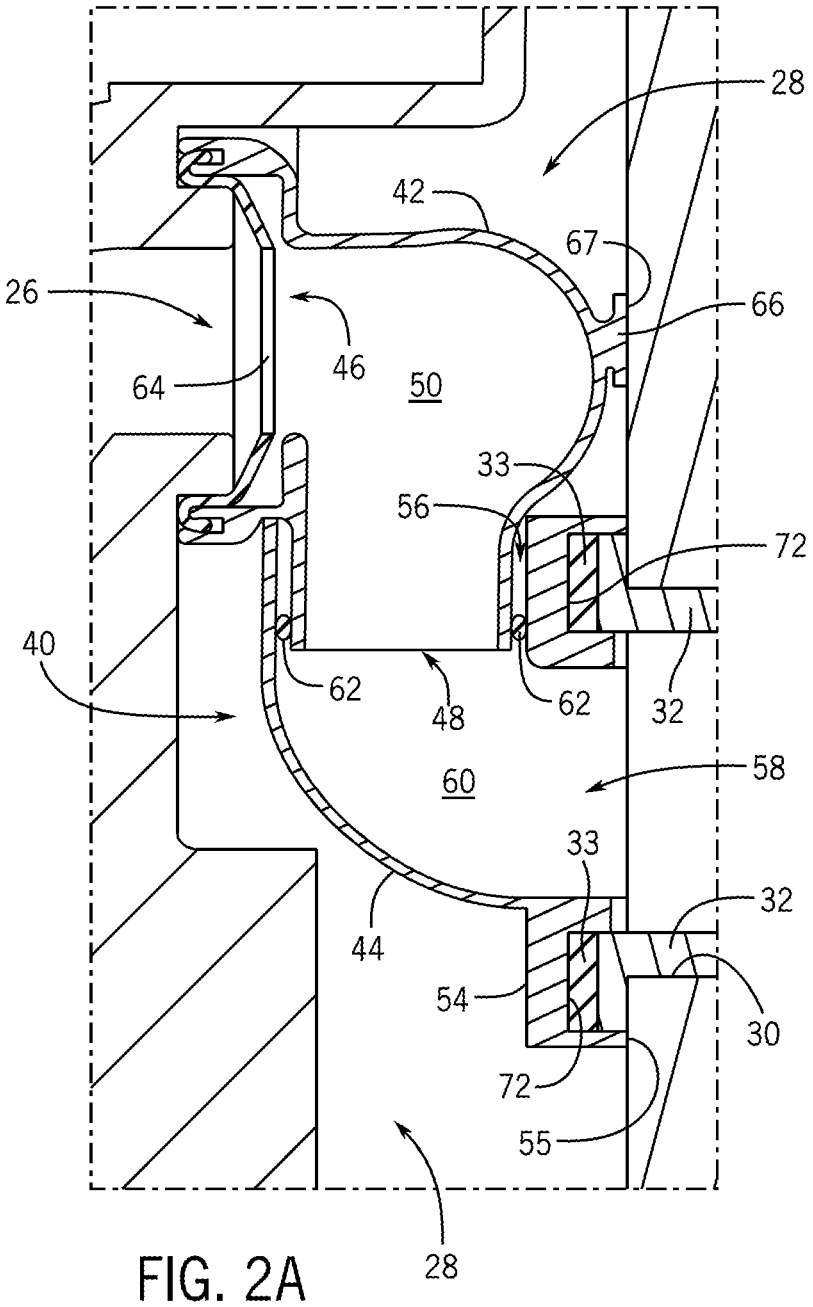
FIG. 2A is a close-up view of FIG. 2, showing the adjustable trapway assembly.

Referring now to FIG. 2, the toilet 2 is shown in more detail. The bowl 6 defines a sump 20 at a lower portion thereof, the sump 20 configured to collect water and waste (i.e., refuse) for discharging from the bowl 6. A discharge pipe 22 defines a discharge pipe inlet 24 (i.e., inlet, first end, upstream end, etc.) and a discharge pipe outlet 26 (i.e., outlet, second end, downstream end, etc.) at opposing ends thereof. The discharge pipe inlet 24 is disposed at the sump 20 and the discharge pipe 22 extends upward from the sump 20, forming an up leg with a substantially "S" shaped path, such that the discharge pipe outlet 26 is disposed at a position higher than the discharge pipe inlet 24 and the sump 20. For example, the discharge pipe outlet 26 may be disposed at an uppermost portion of the discharge pipe 22.

The toilet 2 further defines a cavity 28 formed by the rear wall 12, between the discharge pipe outlet 26 and the wall 16. The cavity 28 is configured to surround (i.e., house, enclose, conceal, etc.) an opening 30 in the wall 16, the opening 30 supporting a wall carrier 32. The wall carrier 32 is configured to remove waste from the toilet 2 and transfer it to a plumbing system in a building. Conventionally, the wall carrier 32 is disposed in the wall 16 for coupling a wall-mounted toilet thereto. The wall-mounted toilet includes an outlet, which is directly coupled to the wall carrier 32. Accordingly, the height of a wall-mounted toilet is fixed based on the height of the opening 30 and the wall carrier 32 on the wall 16.

Referring still to FIG. 2, the cavity 28 is configured to house (i.e., surround, enclose, conceal, etc.) a trapway assembly 40. The trapway assembly 40, which includes an upper trapway 42 and a lower trapway 44 separately formed from the upper trapway 42, is configured to fluidly couple the discharge pipe outlet 26 to the wall carrier 32. With the trapway assembly 40 housed in the cavity 28, the toilet 2 may have an appearance of a conventional floor-mounted toilet having a discharge pipe outlet 26 directly coupled to a drainage opening in the floor 18.

Referring now to FIGS. 2A-6, the trapway assembly 40 is shown according to an exemplary embodiment. The upper trapway 42 defines an upper trapway inlet 46 (i.e., inlet, first end, upstream end, etc.) and an upper trapway outlet 48 (i.e., outlet, second end, downstream end, etc.). The upper trapway 42 forms an elbow having a generally "L" shaped (e.g., approximately 90 degree bend) passage 50 extending between the upper trapway inlet 46 and the upper trapway outlet 48. According to an exemplary embodiment, the passage 50 proximate the upper trapway inlet 46 defines an inner diameter substantially the same as an inner diameter of the discharge pipe outlet 26 or other configurations, such that the flow of fluid from the discharge pipe 22 to the upper trapway 42 is not restricted. The passage 50 may include a generally spherical portion 52 for redirecting water and/or waste flowing from the discharge pipe outlet 26 along a substantially horizontal axis, defined by the upper trapway inlet 46 to a substantially vertical axis, defined by the upper trapway outlet 48. The spherical portion 52 redirects the water and/or waste over a shorter distance than a conventional sweeping trapway, reducing the required distance the discharge pipe outlet 26 needs to be offset from the wall 16 in order to position the trapway assembly 40 within the cavity 28. In this configuration, the bowl 6 may be positioned at a distance from the wall 16 substantially similar to a distance of a bowl in a conventional wall-mounted toilet.

The lower trapway 44 defines a lower trapway inlet 56 (i.e., inlet, first end, upstream end, etc.) and a lower trapway outlet 58 (i.e., outlet, second end, downstream end, etc.). The lower trapway 44 forms an elbow having a generally "L" shaped (e.g., approximately 90 degree bend) passage 60 extending between the lower trapway inlet 56 and the lower trapway outlet 58. The passage 60 is configured to redirect water flowing from the upper trapway outlet 48 along a substantially vertical axis, defined by the lower trapway inlet 56 to a substantially horizontal axis, defined by the lower trapway outlet 58. The lower trapway inlet 56 defines an inner diameter that is substantially the same as or greater than an outer diameter of the upper trapway outlet 48, such that the lower trapway inlet 56 is configured to receive the upper trapway outlet 48 therein. A mounting plate 54 may be formed at the lower trapway outlet 58 and is configured to couple the trapway assembly 40 to the wall 16 proximate (i.e., about) the wall carrier 32. As shown in FIG. 1, the mounting plate 54 may be fully concealed in the cavity 28, although according to other exemplary embodiments, at least a portion of the mounting plate 54 may be exposed.

Figure 3:
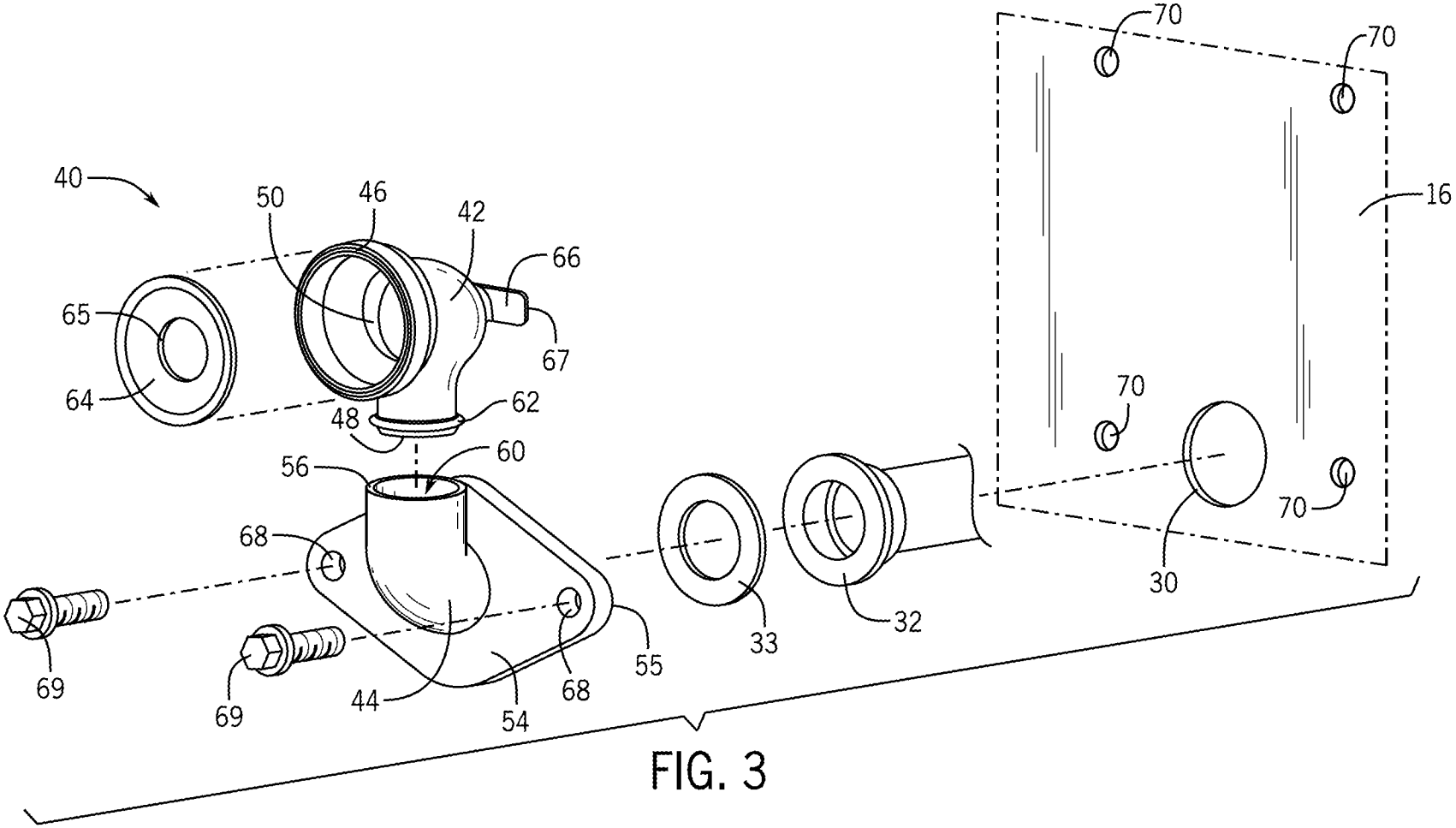
FIG. 3 is an exploded view of the trapway assembly, including an upper trapway and a lower trapway, according to an exemplary embodiment.
Figure 5:
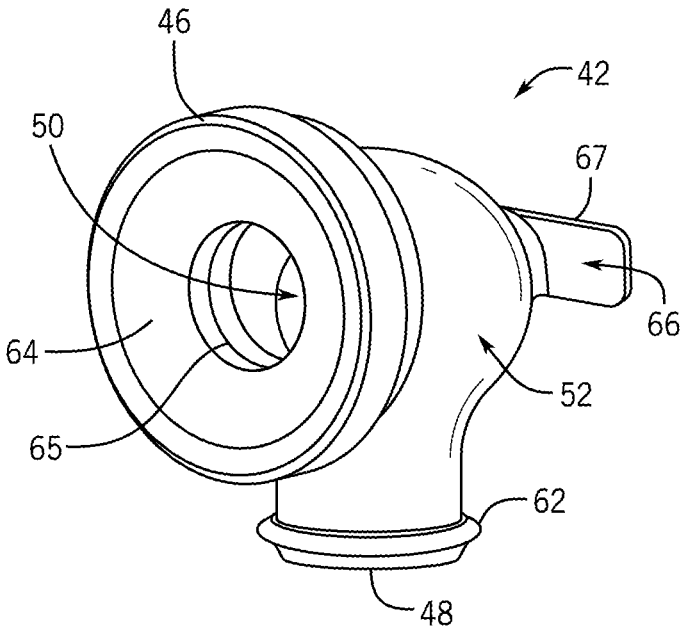
FIG. 5 shows the upper trapway of FIG. 3.

As shown in FIGS. 3 and 5, at least one O-ring 62 (e.g., seal, gasket, etc.) is disposed about an exterior surface of the upper trapway 42, proximate the upper trapway outlet 48. The O-ring 62 may be formed from rubber or other compressible material configured to sealingly engage the outer diameter of the upper trapway outlet 48 and the inner diameter of the lower trapway inlet 56. While FIGS. 3 and 5 show the upper trapway 42 having one O-ring 62, according to other exemplary embodiments, more O-rings 62 may be used to form a sealing engagement between the upper trapway 42 and the lower trapway 44. According to other exemplary embodiments, the upper trapway 42 and the lower trapway 44 may be sealingly coupled in other ways or may be coupled without sealing engagement.

Figure 4:
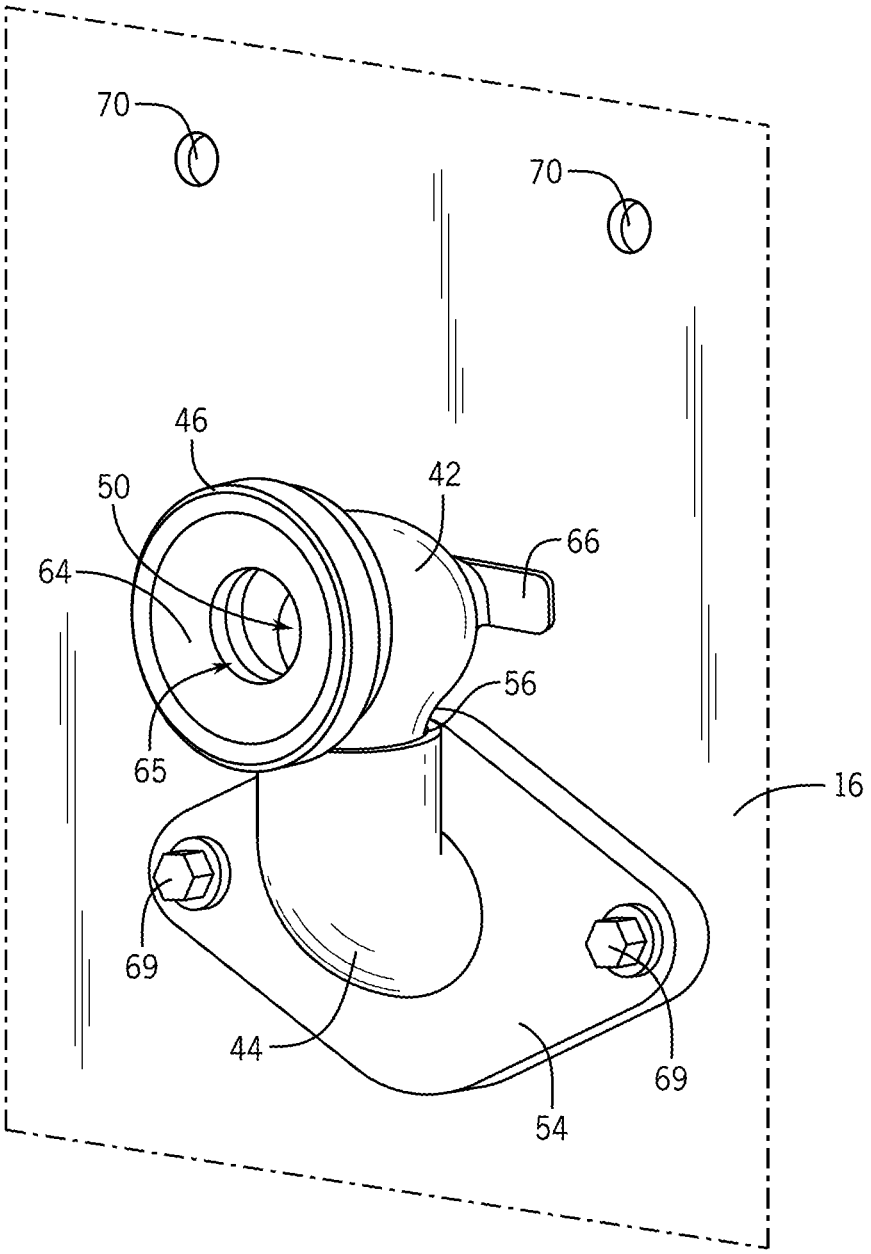
FIG. 4 shows the trapway assembly of FIG. 3 installed on a wall.

In order to assemble the trapway assembly 40 as shown in FIG. 4, the upper trapway outlet 48 is inserted in (i.e., received in) the lower trapway inlet 56 and lowered until the O-ring 62 engages the lower trapway inlet 56. When the O-ring 62 engages the lower trapway inlet 56, it is compressed generally inward toward the upper trapway outlet 48. A vertical position of the upper trapway 42 relative to the lower trapway 44 is adjusted by applying a vertical load to at least one of the upper trapway 42 and the lower trapway 44 sufficient to overcome friction between the O-ring 62 and at least one of the upper trapway 42 and the lower trapway 44. Whereas the position of the lower trapway 44 may be fixed based on the position of the wall carrier 32, a height of the upper trapway inlet 46 may be adjusted by moving the upper trapway 42 within the lower trapway inlet 56. For example, in order to raise the height of the upper trapway inlet 46, the upper trapway outlet 48 is partially withdrawn from (e.g., raised relative to) the lower trapway inlet 56. In order to lower the height of the upper trapway inlet 46, the upper trapway outlet 48 is further inserted into (i.e., received in) the lower trapway inlet 56.

The height of the upper trapway 42 may be adjustable such that the same trapway assembly 40 may accommodate toilets 2 having discharge pipe outlets 26 at different heights. Similarly, the height of the upper trapway 42 may be adjustable such that the same trapway assembly 40 may accommodate toilets 2 having discharge pipe outlets 26 at the same height, but where the wall carrier 32 is at different heights. Frictional engagement between the O-ring 62 and the lower trapway inlet 56 may be configured to hold the upper trapway 42 at a desired height relative to the lower trapway 44. For example, the material forming the O-ring 62 may be selected to provide a desired frictional resistance between the O-ring 62 and the lower trapway inlet 56, such that the upper trapway 42 remains in position in the lower trapway 44 when released. According to other exemplary embodiments, the position of the upper trapway 42 in the lower trapway 44 may be fixed in other ways.

While FIG. 3 shows the upper trapway outlet 48 received in the lower trapway inlet 54, according to another exemplary embodiment, the lower trapway inlet 54 may be received in the upper trapway outlet 48. For example, the upper trapway outlet 48 may define an inner diameter substantially the same as or greater than an outer diameter of the lower trapway inlet 54. In this configuration, the O-ring 60 may be disposed about the lower trapway 44, proximate the lower trapway inlet 54 for sealingly engaging the upper trapway outlet 48.

Referring to FIG. 5, the upper trapway 42 includes a seal 64 (i.e., boot, gasket, O-ring, etc.) disposed in the upper trapway inlet 46. The seal 64 may be formed from rubber or other compressible material configured to provide sealing engagement between the discharge pipe outlet 26 and the upper trapway 42. The seal 64 defines an opening 65 therethrough having an inner diameter substantially the same as the inner diameter of the passage 50 of the upper trapway 42, such that the flow of fluid from the discharge pipe 22 to the upper trapway 42 is not restricted by the seal 64. An outer surface of the seal 64 may define a profile complementary to an inner surface of the upper trapway inlet 46, such that the seal 64 nests within the upper trapway inlet 46. Each of the seal 64 and the upper trapway inlet 46 may define an outer diameter greater than an outer diameter of the discharge pipe outlet 26, such that the discharge pipe outlet 26 is fully surrounded by the seal 64 when the toilet 2 is installed against the trapway assembly 40. In this configuration, the discharge pipe 22 and the trapway assembly 40 may be fluidly coupled and sealingly engaged without restricting the flow of fluid from the discharge pipe 22 to the upper trapway 42.

As shown in FIGS. 3-5, a flange 66 extends laterally from a rear portion of the upper trapway 42. The flange 66 is offset from and substantially parallel to the upper trapway inlet 46 and is configured to engage the wall 16 when the upper trapway 42 is installed in the lower trapway 44 on the wall 16. For example, when the upper trapway 42 is installed in the lower trapway 44, the flange 66 may extend substantially over the mounting plate 54 such that each of the mounting plate 54 and the flange 66 engage the wall 16. According to an exemplary embodiment, a distance from a rear side 67 (e.g., proximate the wall 16) of the flange 66 and an axis of the upper trapway outlet 48 may be substantially the same as a distance from a rear side 55 (e.g., proximate the wall 16) of the mounting plate 54 to an axis of the lower trapway inlet 56.

As shown in FIG. 4, when the trapway assembly 40 is coupled to the wall 16, the rear side 67 of the flange 66 engages the wall 16. In this configuration, when the toilet 2 is installed and moved toward the wall 16, the seal 64 is compressed between the discharge pipe outlet 26 and the upper trapway inlet 46, forming a sealing engagement therebetween. The interaction between the flange 66 and the wall 16 limits or prevents lateral movement of the upper trapway 42 when the toilet 2 is pressed against the upper trapway 42. By providing the lateral support during installation, the shearing and bending forces on the trapway assembly 40 are reduced, minimizing the likelihood of damaging the trapway assembly 40 during installation of the toilet 2. According to an exemplary embodiment, the flange 66 may be secured (e.g., bolted, adhered, etc.) to the wall 16 such that the upper trapway 42 is held in a fixed position relative to the lower trapway 44.

Figure 6:
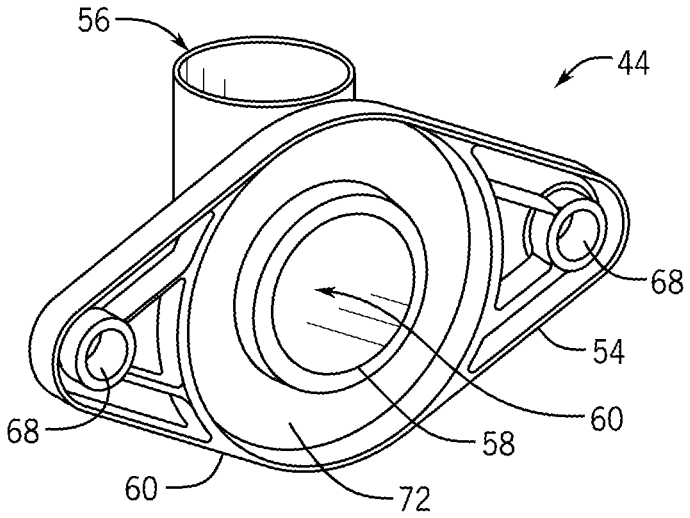
FIG. 6 shows the lower trapway of FIG. 3.

Referring now to FIG. 6, the lower trapway 44 is shown according to an exemplary embodiment. The mounting plate 54 defines a plurality of holes 68 extending therethrough for coupling the lower trapway 44 to the wall 16 proximate the wall carrier 32. As shown in FIG. 3, each of the holes may be spaced apart from the lower trapway outlet 58 and configured to engage corresponding mounting points 70 (e.g., holes, threaded openings, etc.) formed in the wall 16. For example, the mounting points 70 may be initially formed to support a wall-mounted toilet on the wall 16. In the present configuration, fasteners 69 (e.g., bolts, screws, etc.) may be received through the holes 68 in the mounting plate 54 and threadably received in the mounting points 70, thereby coupling the trapway assembly 40 to the wall 16. According to other exemplary embodiments, the trapway assembly 40 may be secured to the wall 16 in other ways. For example, the fasteners 69 may be permanently fixed within the wall 16 and extend outward therefrom. When the toilet 2 is installed against the wall 16, the fasteners 69 are fed through the slots 14 and a nut or other fastening device is coupled to the fasteners 69 against the rear wall 12 of the toilet 2 to secure the toilet 2 in place relative to the wall 16.

In either configuration, the same mounting points 70 originally used for a wall-mounted toilet may be used to secure the toilet 2 in the present application in place.

As shown in FIG. 6, the lower trapway 44 defines an annular groove 72 formed in the mounting plate 54, about the lower trapway outlet 58. The groove 72 is configured to receive and sealingly engage a wall carrier seal 33 (i.e., boot, gasket, O-ring, etc.) disposed at the wall carrier 32. The wall carrier seal 33 may form a shape substantially complementary to at least one of the groove 72 and the wall carrier 32. The wall carrier seal 33 may be formed from rubber or other compressible material configured to provide sealing engagement between the lower trapway outlet 58 and the wall carrier 32. For example, the interaction between the wall carrier seal 33 and each of the groove 72 and the wall carrier 32 prevents leakage from the fluid connection between lower trapway 44 and the wall carrier 32. According to another exemplary embodiment, the wall carrier seal 32 may be coupled to the lower trapway 44 at the groove 72 and received by the wall carrier 32 when the lower trapway 44 is installed on the wall 16.

During installation of the toilet 2, the wall-mounted toilet is disconnected and removed from the wall 16. The upper trapway 42 is received in the lower trapway 44 and the trapway assembly 40 is coupled to the wall 16 by positioning the mounting plate 54 proximate to the wall carrier 32 and feeding fasteners 69 through the holes 68, into the mounting points 70. As the fasteners 69 are tightened (i.e., threaded) in the mounting points 70, the mounting plate 54 is brought closer to the wall 16 and the wall carrier 32, such that the wall carrier seal 33 is compressed between the groove 72 and the wall carrier 32, forming the sealing engagement therebetween. The upper trapway 42 is then positioned within the lower trapway 44 based on a height of the discharge pipe outlet 26 above the floor 18. For example, the height of the discharge pipe outlet 26 is measured and the upper trapway 42 is vertically adjusted relative to the lower trapway 44 until the upper trapway inlet 46 is aligned with and positioned at the same height as the discharge pipe outlet 26. The toilet 2 is then positioned proximate the wall 16 at the wall carrier 32, such that the trapway assembly 40 is disposed within the cavity 28.

As shown in FIG. 3, the wall 16 may include at least four mounting points 70, although according to other exemplary embodiments, more or fewer mounting points 70 may be used. The mounting points 70 may form a substantially rectangular grid, with upper mounting points 70 configured for coupling the toilet 2 thereto and lower mounting points 70 configured for coupling the trapway assembly 40 thereto.

As shown in FIG. 1, the slots 14 are elongated and oriented substantially vertically, such that the slots 14 are configured to align with mounting points 70 at various heights. For example, the height of a wall-mounted toilet is determined by the height of the mounting points 70. Accordingly, the mounting points 70 for a wall-mounted toilet for ADA-approved access may be lower than the mounting points 70 for a wall-mounted toilet at a standard commercial height. In the present configuration, the slots 14 enable the same toilet 2 to be coupled to the mounting points 70 regardless of the height of the wall-mounted toilet being replaced. According to other exemplary embodiments, the slots 14 may define other shapes (e.g., generally circular holes), such that the toilet 2 may be mounted to the wall 16 at a specific height.

Referring still to FIG. 1, a fastener 74 (e.g., bolt, screw, etc.) is fed through each of the slots 14 and threadably received in a corresponding mounting point 70. In this configuration, the discharge pipe outlet 26 of the toilet 2 engages the upper trapway inlet 46 through the seal 64, disposed therebetween. Before the fasteners 74 are tightened, the seal 64 is substantially uncompressed. As the fasteners 74 are tightened, the toilet 2 is moved slightly toward the wall 16 and the seal 64 is compressed. In this configuration, the toilet 2 may be installed in the bathroom without being coupled to the floor 18. According to other exemplary embodiments, the toilet 2 may be secured to at least one of the wall 16 or the floor 18 in other ways, such that the discharge pipe outlet 26 is held securely against the upper trapway inlet 46 and the seal 64 is compressed therebetween.

Figure 7:
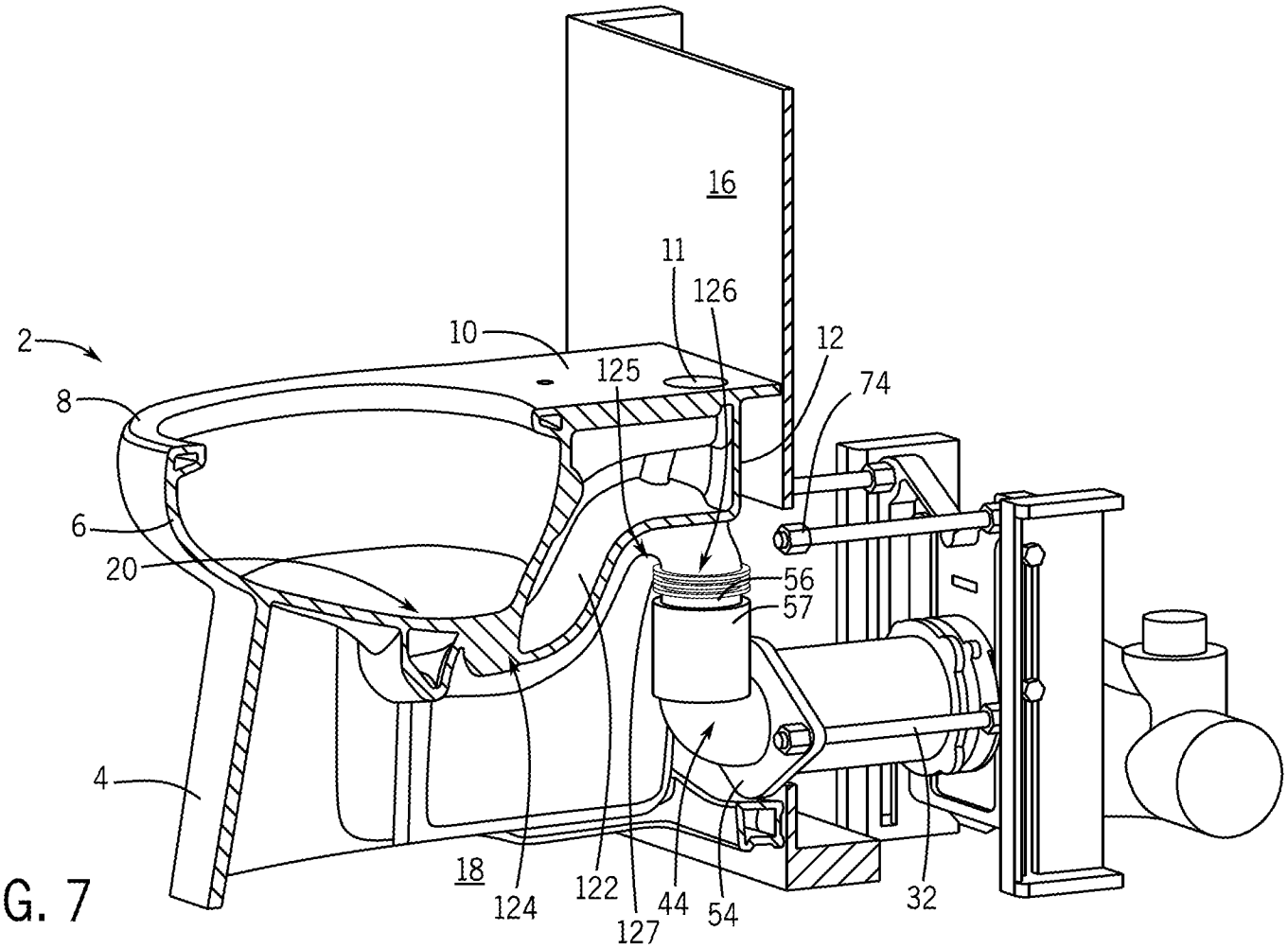
FIG. 7 shows a toilet with a drain pipe outlet coupled to a lower trapway, according to an exemplary embodiment.

Referring now to FIG. 7, the toilet 2 is shown according to another exemplary embodiment. The toilet 2 may be substantially the same as or similar to the toilet 2 as shown in FIGS. 1 and 2, except as described below. Elements having the same or similar names and similar reference numerals may be substantially the same, except as described below. For example, the toilet 2 may include a discharge pipe 122 extending downstream from the sump 20. The discharge pipe 122 is configured to transfer water and waste from the sump 20 to the wall carrier 32. The discharge pipe 122 defines a discharge pipe inlet 124 (i.e., inlet, first end, upstream end, etc.) and a discharge pipe outlet 126 (i.e., outlet, second end, downstream end, etc.) at opposing ends thereof. The discharge pipe inlet 124 is disposed at the sump 20 and the discharge pipe 122 extends upward from the sump 20, forming an up leg with a substantially "S" shaped path, a down leg (e.g., defining an elbow), and an upper peak 125 (e.g., uppermost portion) disposed therebetween. The discharge pipe outlet 126 may be disposed below the upper peak 125, such that the discharge pipe 122, either alone or in combination with the lower trapway 44 forms an airlock to prevent gases from being introduced through the discharge pipe 122 to the sump 20.

As shown in FIG. 7, the discharge pipe outlet 126 may define an axis extending therethrough. The axis of the discharge pipe outlet 126 may be substantially vertical (e.g., perpendicular to the floor 18) or may define other orientations. In this configuration, the discharge pipe 122 is configured to extend downstream from the upper peak 125 in a generally downward, such that the discharge pipe 122 defines a generally vertical section proximate to the discharge pipe outlet 126. At least a portion of the vertical section is configured to be fluidly coupled to (e.g., received in) the lower trapway inlet 56.

Figure 8:
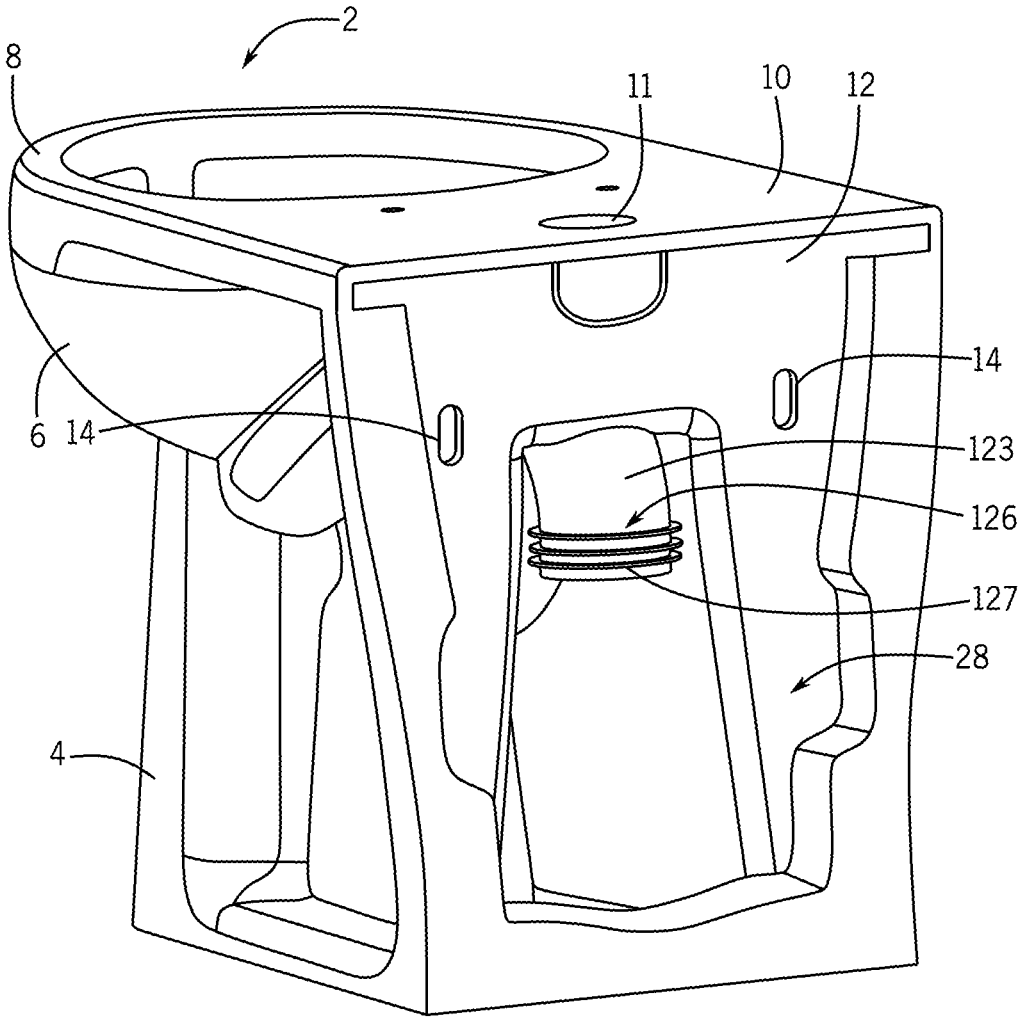
FIG. 8 is a rear perspective view of the toilet of FIG. 7.

Referring now to FIG. 8, the discharge pipe 122 of the toilet 2 is shown according to an exemplary embodiment. A gasket 127 is disposed proximate the discharge pipe outlet 126 and is configured to sealingly engage the discharge pipe 122 and the lower trapway 44. For example, the gasket 127 may be formed from rubber or other suitable compressible material configured to provide sealing engagement between the discharge pipe 122 and the lower trapway 44. The discharge pipe outlet 126 and therefore the gasket 127 extend into and are disposed in the cavity 28 for coupling to the lower trapway 44 within the cavity 28. The cavity 28 is configured to conceal the discharge pipe outlet 126 and the lower trapway 44 when the toilet 2 is installed against the wall 16. The cavity 28 may be defined by the base 4 and the upper surface 10 as an integrally-formed toilet 2, and fully conceals the lower trapway 44, in order to provide the appearance of a conventional floor-mounted toilet with a drain opening in the floor, even though the toilet 2 is connected to a wall carrier 32. This configuration enables an installer to convert a bathroom originally having wall-mounted toilets to the present toilet 2 without the appearance of a conversion (e.g., with dummy plates covering previous wall mounting points), providing a desired aesthetic appearance of an original installation of the toilet 2.

Figure 9:
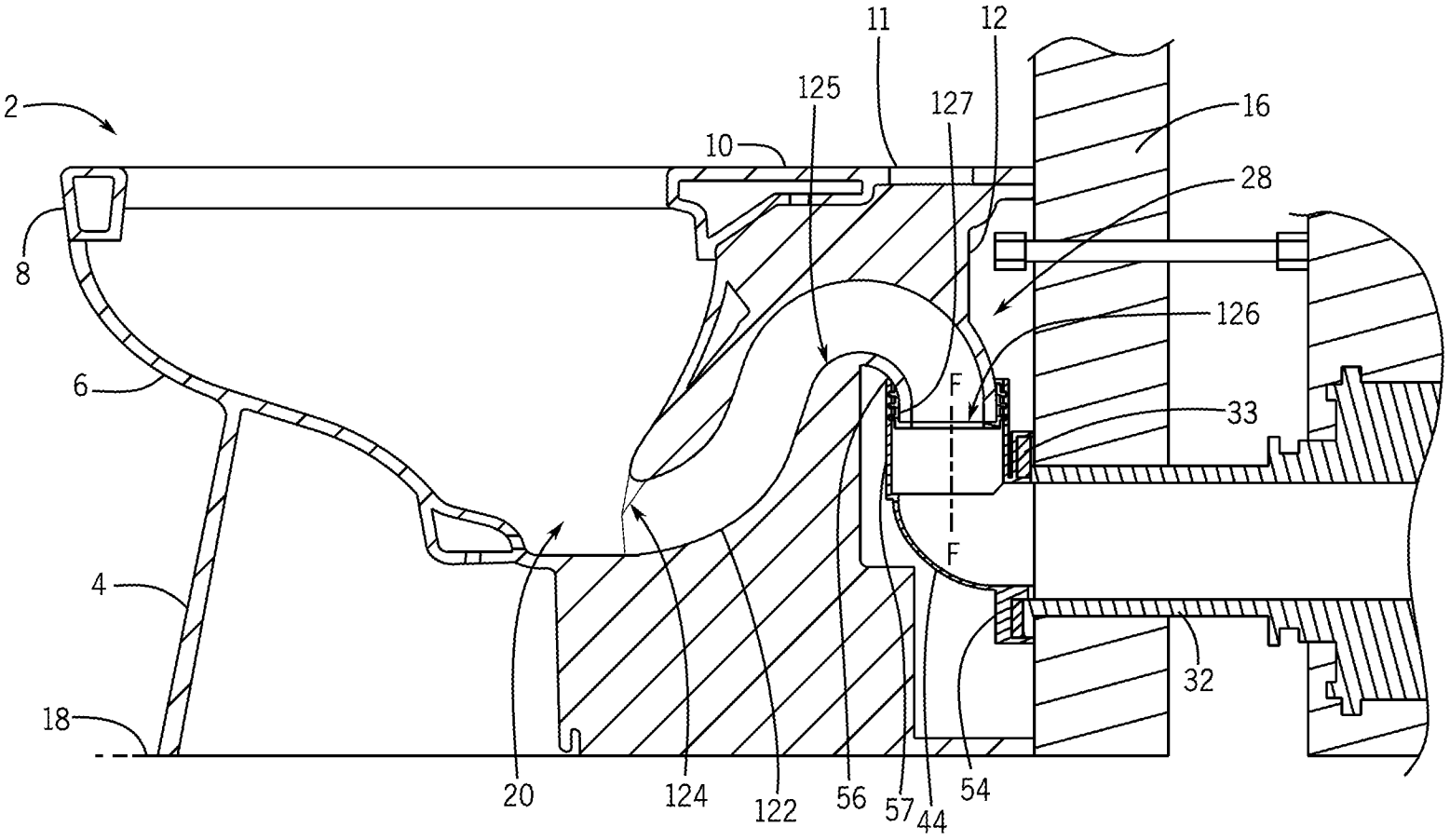
FIG. 9 shows the toilet of FIG. 7 fully installed, according to an exemplary embodiment.

The gasket 127 may be disposed annularly about an outer surface of the discharge pipe 122 proximate the discharge pipe outlet 126. For example, as shown in FIG. 9, when the toilet 2 is installed on the lower trapway 44, the discharge pipe outlet 126 is received in the lower trapway inlet 56, such that the gasket 127 is disposed between the discharge pipe 122 and the lower trapway 44 (e.g., annularly about the discharge pipe 122 and annularly within the lower trapway 44), forming a sealing engagement therebetween. According to another exemplary embodiment, the gasket 127 may be coupled to the discharge pipe 122 and/or the lower trapway 44 in other ways. For example, the gasket 127 may be disposed within the lower trapway 44 and the discharge pipe outlet 126 may be received within the gasket 127 as the toilet 2 is installed on the lower trapway 44. According to another exemplary embodiment, when the toilet 2 is installed on the lower trapway 44, the discharge pipe outlet 126 may be spaced apart from the lower trapway inlet 56, with the gasket 127 extending therebetween. It should be recognized that the gasket 127 may include more than one (e.g., three) gaskets 127 disposed between the discharge pipe 122 and the lower trapway 44.

While FIG. 9 shows the discharge pipe outlet 126 and the gasket 127 received in the lower trapway inlet 56, according to other exemplary embodiments, the discharge pipe outlet may define an inner diameter greater than an outer diameter of the lower trapway inlet 56. In this configuration, the gasket 127 may be disposed within the discharge pipe 122 proximate the discharge pipe outlet 126 and/or disposed about the lower trapway 44 proximate to the lower trapway inlet 56, such that the discharge pipe outlet 126 is configured to be received in the lower trapway inlet 56 and the gasket 127 is configured to be compressed between and sealingly engage the discharge pipe 122 and the lower trapway 44.

Referring to FIGS. 7-9, the passage 60 of the lower trapway 44 defines an upper (i.e., first, upstream, etc.) section 57, positioned generally upstream from the elbow forming the "L" shape of the passage 60. The upper section 57 may extend generally vertically when the lower trapway 44 is installed on the wall 16, such that the upper section 57 is configured to receive the discharge pipe outlet 126 and/or the gasket 127 therein. For example, the upper section 57 may define a generally annular inner profile or other inner profile complementary to an outer profile of the discharge pipe 122 proximate to the discharge pipe outlet 126.

As shown in FIGS. 7 and 9, the discharge pipe outlet 126 is received directly in the upper section 57 of the lower trapway 44 without an intervening pipe (e.g., conduit) separating the lower trapway 44 from the discharge pipe outlet 126. The lower trapway 44, including the upper section 57 is integrally-formed as a single component for directly receiving the discharge pipe outlet 126. This configuration minimizes the number of joints that must be sealed with gaskets 127, improving the likelihood of forming a strong seal between the discharge pipe 122 and the wall carrier 32 for preventing leaks of waste gas or water passing from the discharge pipe 122 to the wall carrier 32. Further, the addition of intervening pipe sections would reduce the operational efficiency of a toilet. For example, at a joint between two adjacent conduits, turbulence is formed in the flow, thereby causing energy losses in the fluid and reducing the efficiency of the flush cycle. Specifically, when the internal diameter changes moving from one conduit to another, especially when the downstream diameter is smaller than the upstream diameter, vortices form in the flow at the joint and generate turbulence downstream from the joint. Even if the internal diameter between adjacent pipe sections is similar or the same, fluid friction at the joint itself can still cause turbulence in the same way. Accordingly, it may be advantageous to connect the discharge pipe 122 to the lower trapway 44 without any intervening pipe sections. While FIGS. 7-9 show the upper section 57 integrally formed with the rest of the lower trapway 44, according to other exemplary embodiments, the upper section 57 may define a separately formed sleeve (i.e., collar, extension, etc.) fluidly coupled to and extending between the discharge pipe outlet 126 and the elbow formed by the lower trapway 44.

Referring to FIGS. 7-9, a method of installing the toilet 2 on the lower trapway 44 is shown according to an exemplary embodiment. A height of the discharge pipe outlet 126 above the floor 18 is measured or is pre-determined. The upper section 57 of the lower trapway 44 is cut, forming a new upper edge defining the lower trapway inlet 56. For example, as the upper section 57 is cut, the lower trapway inlet 56 is defined at the newly-lowered upper edge of the upper section 57. The upper section 57 may be cut until the lower trapway inlet 56 is disposed at a height above the floor 18 substantially the same as or greater than the height of the discharge pipe outlet 126. In this configuration, the lower trapway inlet 56 may sealingly engage the discharge pipe outlet 126 by receiving the discharge pipe outlet 126 at or within the lower trapway inlet 56. As shown in FIG. 9, the lower trapway inlet 56 may be cut to a height that is greater than (i.e., further from the floor 18) than the height of the discharge pipe outlet 126.

Referring to FIGS. 7 and 9, once the upper section 57 is cut to the desired height, the toilet 2 is lifted upward relative to the floor 18 and repositioned proximate to the wall, such that the discharge pipe outlet 126 is aligned generally coaxially with the lower trapway inlet 56. In this position, the toilet 2 is spaced apart from the floor 18 and the rear wall 12 of the toilet 2 is disposed on (e.g., pressed against) the wall 16. The cavity 28 is fully enclosed by the rear wall 12 and the wall 16, such that the discharge pipe outlet 126 and the lower trapway 44 are concealed from view. Once the discharge pipe outlet 126 and the lower trapway inlet 56 are aligned, the toilet 2 is lowered until the discharge pipe outlet 126 is received in the upper section 57 of the lower trapway 44 and the gasket 127 is compressed therebetween to seal the connection between the discharge pipe outlet 126 and the lower trapway, even while the toilet 2 is still spaced apart from the floor 18. As a result of this configuration, even though the discharge pipe outlet 126 and the lower trapway 44 is concealed from view in the cavity 28, an installer can be certain that the discharge pipe 122 is properly fluidly connected to the lower trapway 44 because the interaction of the discharge pipe outlet 126 in the lower trapway 44 will prevent lateral and fore/aft movement of the toilet 2, even before the toilet 2 is lowered onto the floor 18.

As the toilet 2 is further lowered into engagement with the floor 18, the discharge pipe 122 is lowered by a corresponding distance in the upper section 57. The upper section 57 is configured to adjustably receive the discharge pipe outlet 126 and the gasket 127 at various heights (i.e., vertical positions) within the upper section 57, such that at each of the heights, the gasket 127 is compressed, sealing the upper section 57 and the discharge pipe outlet 126. This vertical flexibility of the connection between the discharge pipe 122 and the lower trapway 44 substantially increases the tolerance for sizing the upper section 57. For example, for installation that requires cutting the upper section 57, an installer does not have to precisely measure a height of the discharge pipe outlet 126. Instead, the installer just has to make sure that an upper edge of the upper section 57 is at least slightly higher than the discharge pipe outlet 126. Furthermore, this configuration allows for the toilet 2 to be installed at other heights above the floor 18. Such configurations are discussed in more detail below (e.g., shims described in FIG. 19). This vertical flexibility is further advantageous because the concealment of the discharge pipe outlet 126 and the lower trapway 44 within the cavity makes it difficult to preassemble the toilet 2 on the lower trapway 44 to precisely measure a desired height of the upper section 57.

As described with respect to FIG. 1, the toilet 2 may be coupled to the wall 16 with the fasteners 74 or other means of fastening (e.g., adhesives, bolts, screws, rivets, etc.). Importantly, because the floor-mounted toilet 2 is coupled to the wall 16 to secure the toilet 2 in place, rather than to the floor as in a conventional floor-mounted toilet, no additional modification of the bathroom is required in order to install the toilet 2. In this configuration, the connection of the toilet 2 to the wall 16 secures the toilet 2 in a stationary position while using the existing mounting bracket for the wall-hung toilet being replaced. However, the interaction of the toilet 2 with the floor 18 supports vertical loads of a user sitting on the toilet 2 and can support a greater weight than a wall-hung toilet.

According to another exemplary embodiment, the lower trapway 44 may be adjustable relative to the wall 16, such that the horizontal (i.e., lateral) position of the lower trapway inlet 56 may be moved (e.g., repositioned, shifted, etc.) closer to or further away from the wall 16 until the lower trapway inlet 56 is aligned generally coaxially with the discharge pipe outlet 126. Similarly, the lower trapway 44 may be loosely connected to the wall 16 with the fasteners 69 discussed with respect to FIG. 4. When the lower trapway 44 is loosely connected to the wall 16, the wall carrier seal 33 may be uncompressed or partially-compressed. As the toilet 2 is connected to the wall 16 with fasteners 74, lateral force may be applied on the lower trapway 44 by the discharge pipe outlet 126 to move the lower trapway 44 closer to the wall 16 in order to further compress the wall carrier seal 33 between the mounting plate 54 and the wall carrier 32 in order to improve the seal therebetween.

It should be recognized that in a conventional floor-mounted toilet, the toilet secured in place by joining the toilet to the floor 18 with a mounting bracket. In such a configuration, it is difficult to place a mounting bracket on the floor at the correct location to ensure that when the toilet is installed, the wall carrier seal 33 is compressed. In contrast, because the toilet 2 in the present application includes the cavity 28, which conceals the lower trapway 44 and discharge pipe outlet 126 from view during installation of the toilet 2, the connection of the rear wall 12 of the toilet 2 to the wall 16, rather than a portion of the toilet 2 to the floor 18, simplifies installation of the toilet 2 and ensures a watertight connection with the wall carrier 32. Furthermore, the tight connection ensures that noxious waste gas does not leak from the water carrier 32 into the environment.

Figure 10:
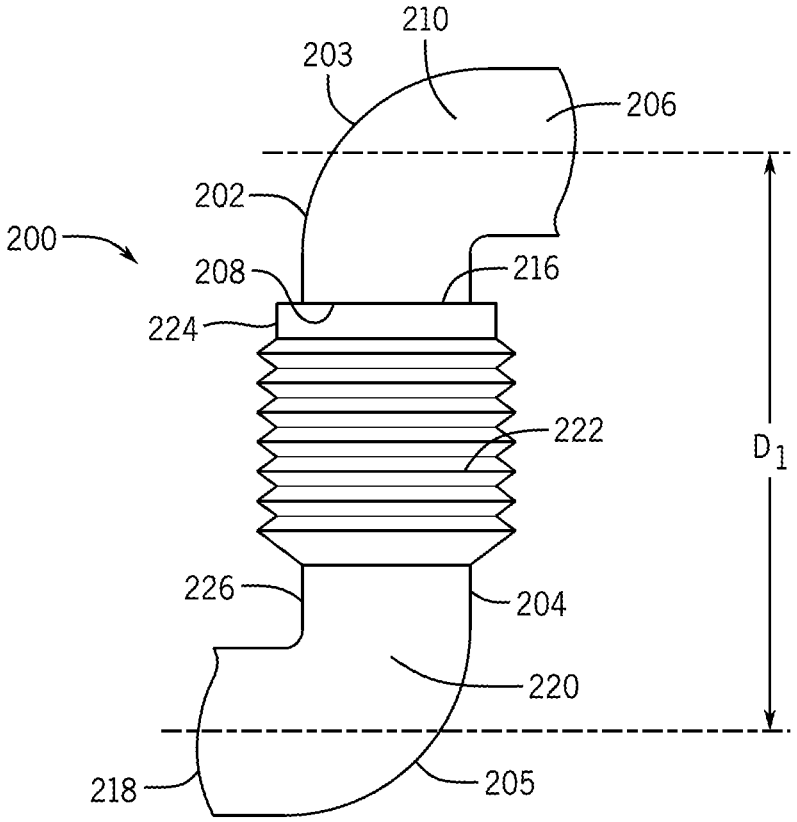
FIG. 10 is a side elevation view of an adjustable trapway according to another exemplary embodiment.

Referring to FIG. 10, a trapway assembly 200 is shown according to an exemplary embodiment. The trapway assembly 200, which includes an upper trapway 202 and a lower trapway 204 separately formed from the upper trapway 202, is configured to fluidly couple the discharge pipe outlet 26 to the wall carrier 32. The upper trapway 202 defines an upper trapway inlet 206 (i.e., inlet, first end, upstream end, etc.) and an upper trapway outlet 208 (i.e., outlet, second end, downstream end, etc.). The upper trapway 202 forms an upper elbow 203 having a generally "L" shaped (e.g., approximately 90 degree bend) passage 210 extending between the upper trapway inlet 206 and the upper trapway outlet 208. The passage 210 is configured to redirect water flowing from the discharge pipe outlet 26 along a substantially horizontal axis, defined by the upper trapway inlet 206 to a substantially vertical axis, defined by the upper trapway outlet 208. According to an exemplary embodiment, the passage 210 proximate the upper trapway inlet 206 defines an inner diameter substantially the same as an inner diameter of the discharge pipe outlet 26 or other configurations, such that the flow of fluid from the discharge pipe 22 to the upper trapway 202 is not restricted.

The lower trapway 204 defines a lower trapway inlet 216 (i.e., inlet, first end, upstream end, etc.) and a lower trapway outlet 218 (i.e., outlet, second end, downstream end, etc.). The lower trapway 204 forms a lower elbow 205 having a generally "L" shaped (e.g., approximately 90 degree bend) passage 220 extending between the lower trapway inlet 216 and the lower trapway outlet 218. The passage 220 is configured to redirect water flowing from the upper trapway outlet 208 along a substantially vertical axis, defined by the lower trapway inlet 216 to a substantially horizontal axis, defined by the lower trapway outlet 218. The lower trapway inlet 216 defines an inner diameter that is substantially the same as or greater than an outer diameter of the upper trapway outlet 208, such that the lower trapway inlet 216 is configured to receive the upper trapway outlet 208 therein. The lower trapway 204 may be fluidly coupled to the wall carrier 32 in substantially the same way as the lower trapway 44 shown in FIG. 2 (e.g., with a mounting plate 54), although according to other exemplary embodiments, the lower trapway 204 may be coupled to the wall carrier 32 in other ways.

Referring still to FIG. 10, the lower trapway 204 includes a first expansion section 222. The first expansion section 222 may be defined downstream from the lower trapway inlet 216 and configured expand and/or contract, such that a distance $D_1$ between a centerline of the upper trapway inlet 206 and a centerline of the lower trapway outlet 218 is adjustable. The expansion section 222 includes an accordion structure for increasing a length of the passage 220. As shown in FIG. 10, the first expansion section 222 is disposed in a vertically-oriented portion of the lower trapway 204, such that by expanding the first expansion section 222, the upper trapway inlet 206 may be coupled to the discharge pipe outlet 26 at a higher height above the floor 18 while maintaining a fluid connection with the lower trapway 204. Furthermore, the first expansion section 222 may be contracted, such that the trapway assembly 200 is configured to couple the upper trapway inlet 206 to the discharge pipe outlet 26 at a lower height above the floor 18, without cutting or structurally modifying either of the upper trapway 202 or lower trapway 204. According to an exemplary embodiment, the first expansion section 222 may be integrally formed with the lower trapway 204. The first expansion section 222 may be formed from the same material as the rest of the lower trapway 204. According to another exemplary embodiment, the lower trapway 204 may include an inlet section 224 and an outlet section 226 separately formed from the inlet section 224. The first expansion section 222 may be separately formed from at least one of the inlet section 224 and the outlet section 226 and disposed therebetween, fluidly coupling the inlet section 224 and the outlet section 226.

According to an exemplary embodiment, the first expansion section 222 may be configured to expand and contract substantially coaxially with the passage 220. According to another exemplary embodiment, the first expansion section 222 may be configured to bend and/or flex. For example, the passage 220 may define a curved (e.g., bent) axis through the first expansion section 222, such that the axis at the inlet section 224 is angularly offset from an axis in the outlet section 226 proximate to the first expansion section 222 (i.e., upstream from the "L" shaped bend. In another example, the axis of the passage 220 in the inlet section 224 may be substantially parallel to and offset from the axis of the passage 220 in the outlet section 226, proximate to the first expansion section 222. In this configuration, the first expansion section 222 may form a curved and/or angled profile, such that the upper trapway 202 may be disposed further away from or closer to the wall 16 than in a configuration where the first expansion section 222 only expands and contracts in a vertical direction.

Figure 11:
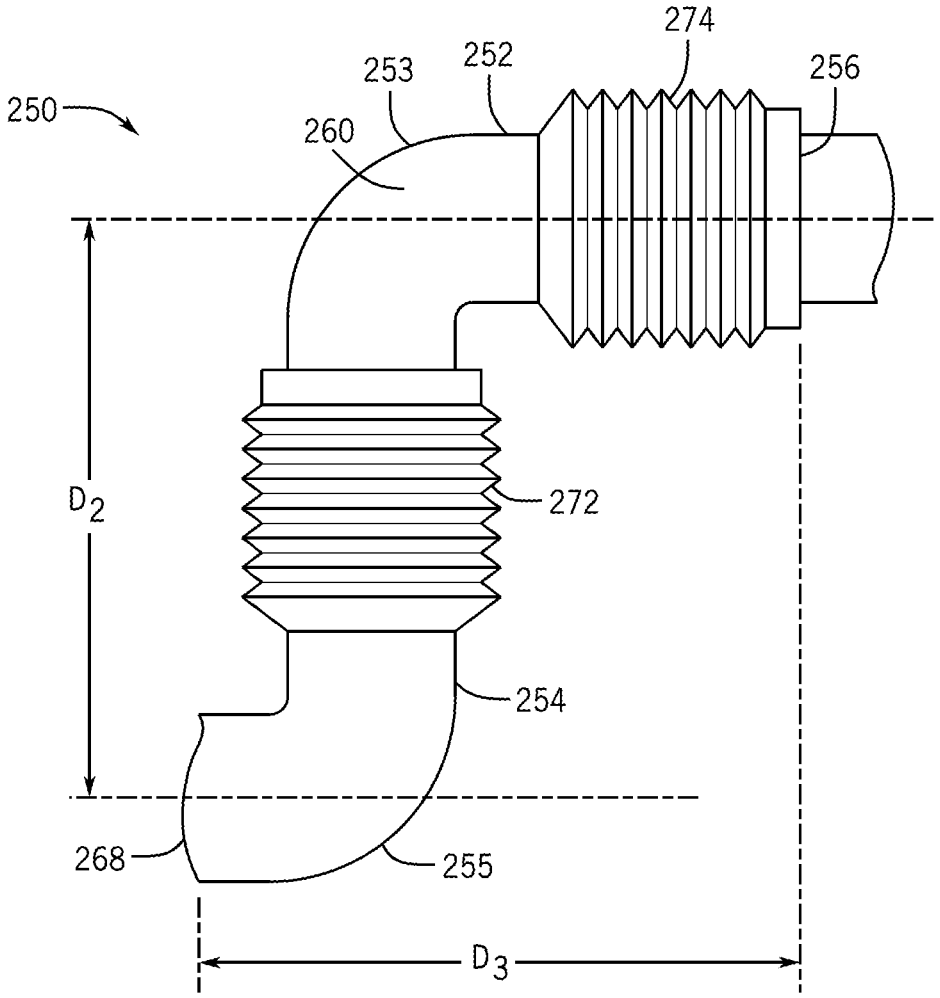
FIG. 11 is a side elevation view of an adjustable trapway according to another exemplary embodiment.

Referring to FIG. 11, a trapway assembly 250 is shown according to an exemplary embodiment. The trapway assembly 250, which includes an upper trapway 252 and a lower trapway 254 integrally formed with the upper trapway 252, is configured to fluidly couple the discharge pipe outlet 26 to the wall carrier 32. The upper trapway 252 defines an upper trapway inlet 256 (i.e., inlet, first end, upstream end, etc.). The upper trapway 252 forms an upper elbow 253 having a generally "L" shape (e.g., approximately 90 degree bend), with a passage 260 extending downstream from the upper trapway inlet 256 toward the lower trapway 204. The passage 260 is configured to redirect water flowing from the discharge pipe outlet 26 along a substantially horizontal axis, defined by the upper trapway inlet 256 to a substantially vertical axis. According to an exemplary embodiment, the passage 260 proximate the upper trapway inlet 256 defines an inner diameter substantially the same as an inner diameter of the discharge pipe outlet 26 or other configurations, such that the flow of fluid from the discharge pipe 22 to the upper trapway 252 is not restricted.

The lower trapway 254 defines a lower trapway outlet 268 (i.e., outlet, second end, downstream end, etc.). The lower trapway 254 forms a lower elbow 255 having a generally "L" shape (e.g., approximately 90 degree bend), further defining the passage 260 extending downstream from the upper trapway 252 to the lower trapway outlet 268. The passage 260 is configured to redirect water flowing from the upper trapway 252 along a substantially vertical axis, to a substantially horizontal axis, defined by the lower trapway outlet 268. The lower trapway 254 may be fluidly coupled to the wall carrier 32 in substantially the same way as the lower trapway 44 shown in FIG. 2 (e.g., with a mounting plate 54), although according to other exemplary embodiments, the lower trapway 254 may be coupled to the wall carrier 32 in other ways.

Referring still to FIG. 11, the lower trapway 254 includes a first expansion section 272. The first expansion section 272 may be defined downstream from the upper elbow 253 and configured expand and/or contract, such that a distance $D_2$ between a centerline of the upper trapway inlet 256 and a centerline of the lower trapway outlet 268 is adjustable. The first expansion section 272 includes an accordion structure for increasing a length of the passage 260. As shown in FIG. 11, the first expansion section 272 is disposed in a vertically-oriented portion of the lower trapway 254 between the upper elbow 253 and the lower elbow 255, such that by expanding the first expansion section 272, the upper trapway inlet 256 may be coupled to the discharge pipe outlet 26 at a higher height above the floor 18 while maintaining a fluid connection with the lower trapway 254. Furthermore, the first expansion section 272 may be contracted, such that the trapway assembly 250 is configured to couple the upper trapway inlet 256 to the discharge pipe outlet 26 at a lower height above the floor 18, without cutting or structurally modifying either of the upper trapway 252 or lower trapway 254.

As shown in FIG. 11, the upper trapway 252 includes a second expansion section 274. The second expansion section 274 may be defined downstream from the upper trapway inlet 256 and upstream from the upper elbow 253. The second expansion section 274 is configured to expand and/or contract, such that a horizontal (i.e., lateral) distance $D_3$ between of the upper trapway inlet 256 and the lower trapway outlet 268 is adjustable. The second expansion section 274 includes an accordion structure for increasing a length of the passage 260. As shown in FIG. 11, the second expansion section 274 is disposed in a horizontally-oriented portion of the upper trapway 252 between the upper elbow 253 and the lower elbow 255, such that by expanding the second expansion section 274, the upper trapway inlet 256 may be brought closer to the discharge pipe outlet 26 for coupling thereto. For example, the trapway assembly 250 may accommodate different toilets that have discharge pipe outlets 26 at different distances from the wall 16. Furthermore, the second expansion section 274 may be contracted, such that the trapway assembly 250 is configured to couple the upper trapway inlet 256 to the discharge pipe outlet 26 where the discharge pipe outlet 26 is close to the wall 16, without cutting or structurally modifying either of the upper trapway 252 or lower trapway 254.

According to an exemplary embodiment, the second expansion section 274 may be integrally formed with the upper and lower trapways 252, 254. The first and second expansion sections 272, 274 may be formed from the same material as the rest of the trapway assembly 250. According to another exemplary embodiment, the first and second expansion sections 272, 274 may be separately formed from the rest of the trapway assembly 250 and fluidly coupled thereto.

According to an exemplary embodiment, the first expansion section 272 may be configured to expand and contract substantially coaxially with the passage 260 extending therethrough. According to another exemplary embodiment, the first expansion section 272 may be configured to bend and/or flex. For example, the passage 260 may define a curved (e.g., bent) axis through the first expansion section 272. In another example, the axis of the passage 260 in the lower trapway 254, proximate to the upper elbow 253 may be substantially parallel to and offset from the axis of the passage 260 in the lower trapway 254, proximate to and upstream from the lower elbow 255. In this configuration, the first expansion section 272 may form a curved and/or angled profile, such that the upper elbow 253 may be disposed further away from or closer to the wall 16 than in a configuration where the first expansion section 272 only expands and contracts in a vertical direction.

According to an exemplary embodiment, the second expansion section 274 may be configured to expand and contract substantially coaxially with the passage 260 extending therethrough. According to another exemplary embodiment, the second expansion section 274 may be configured to bend and/or flex. For example, the passage 260 may define a curved (e.g., bent) axis through the second expansion section 274. In another example, the axis of the passage 260 in the upper trapway 252, upstream from and proximate to the upper elbow 253 may be substantially parallel to and offset from the axis of the upper trapway inlet 256. In this configuration, the second expansion section 274 may form a curved and/or angled profile, such that the upper trapway inlet 256 may be disposed further away from or closer to the floor 18 than in a configuration where the first expansion section 272 only expands and contracts in a vertical direction.

According to an exemplary embodiment, the trapway assembly 250 may be installed on a toilet 2 by coupling the upper trapway inlet 256 to the discharge pipe outlet 26 and the lower trapway outlet 268 to the wall carrier 32 while the toilet 2 is spaced apart from the wall 16. In this configuration, the second expansion section 274 may be elongated (i.e., expanded, stretched, etc.). The toilet 2 is then moved toward the wall 16, causing the second expansion section 274 to contract (i.e., shrink, accordion, etc.) until the toilet 2 is disposed against the wall 16. Using this method, a sealed fluid connection can be formed and verified between the trapway assembly 250 and each of the discharge pipe outlet 26 and the wall carrier 32 before the toilet 2 is fully installed on the wall 16.

While FIG. 11 only shows first and second expansion sections 272, 274, according to other exemplary embodiments, the trapway assembly 250 may include more or fewer expansion sections. For example, the lower trapway 254 may include a third expansion section in a horizontal orientation, proximate to the lower trapway outlet 268 and substantially similar to the second expansion section 274.

Figure 12:
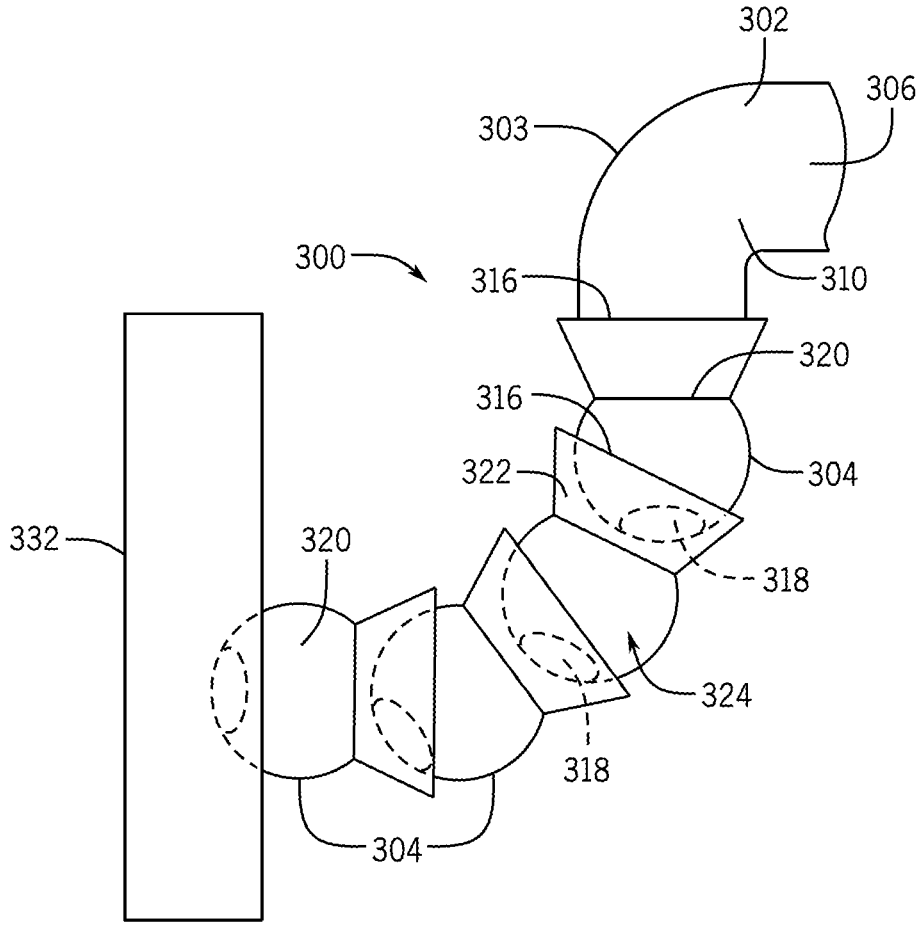
FIG. 12 is a side elevation view of an adjustable trapway assembly according to an exemplary embodiment.

Referring now to FIG. 12, a trapway assembly 300 is shown according to an exemplary embodiment. The trapway assembly 300, which includes an upper trapway 302, a wall carrier 332, and a plurality of ball-and-socket joints 304 fluidly connected therebetween. The upper trapway 302 and joints 304 are configured to fluidly couple the discharge pipe outlet 26 to the wall carrier 332. The wall carrier 332 may be substantially the same as the wall carrier 32 as described above, or may have other configurations according to other exemplary embodiments. The upper trapway 302 defines an upper trapway inlet 306 (i.e., inlet, first end, upstream end, etc.). The upper trapway 302 forms an upper elbow 303 having a generally "L" shape (e.g., approximately 90 degree bend), with a passage 310 extending downstream from the upper trapway inlet 306 toward the plurality of joints 304 fluidly coupled to an upper trapway outlet 308 (i.e., outlet, second end, downstream end, etc.) at an opposing end of the passage 310. The passage 310 is configured to redirect water flowing from the discharge pipe outlet 26 along a substantially horizontal axis, defined by the upper trapway inlet 306 to a substantially vertical axis. According to an exemplary embodiment, the passage 310 proximate the upper trapway inlet 306 defines an inner diameter substantially the same as an inner diameter of the discharge pipe outlet 26 or other configurations, such that the flow of fluid from the discharge pipe 22 to the upper trapway 302 is not restricted.

As shown in FIG. 12, each joint 304 defines a conical inlet section 322 and a spherical outlet section 324. A joint inlet 316 defines an opening at an upstream end of the inlet section 322 and a joint outlet 318 defines an opening at a downstream end of the outlet section 324, at an opposing end of the joint 304. A passage 320 fluidly connects the joint inlet 316 to the joint outlet 318. The inlet section 322 forms a socket configured to receive the outlet section 324 of an adjacent joint 304. For example, the interaction of the inlet section 322 in the outlet section 324 forms a ball-and-socket joint, such that when the outlet section 324 engages a corresponding inlet section 322 of another joint 304, an entire circumference of the outlet section 324 sealingly engages the inlet section 322. In this configuration, the outlet section 324 may be rotated within the corresponding inlet section 322, such that a first joint 304 may be reoriented relative to a second joint 304, while maintaining sealed engagement therewith. Similarly, even as the first joint 304 is rotated, the joint outlet 316 remains fluidly connected to the passage 320 of the second joint 304.

The wall carrier 332 is configured to receive the outlet section 324 of a downstream-most joint 304. The outlet section 324 of the downstream-most joint 304 may be received in the wall carrier 332, such that the joint 304 is configured to rotate (e.g., pivot) therein. In this configuration, the wall carrier 332 may define a shape similar to an inlet section 322 of any of the joints 304. For example, the wall carrier 332 may define a conical opening therein, although the wall carrier 332 may define other shapes configured to sealingly engage the joint 304, such that the joint is configured to rotate therein. The joint 304 may be configured to rotate, such that in any orientation, the joint outlet 318 is configured to fluidly couple the passage 320 to the wall carrier 332. According to another exemplary embodiment, the wall carrier 332 may be configured to receive the joint 304 in a fixed orientation, such that the joint 304 may not rotate within the wall carrier 332. According to other exemplary embodiments, the trapway assembly may include a lower trapway fluidly coupled to the wall carrier 332 at a downstream end thereof. An upstream end of the lower trapway may be configured to receive the downstream-most joint 304 therein.

While the inlet section 322 is shown as a conical structure, according to other exemplary embodiments, the inlet section 322 may have other shapes configured to receive the upper trapway outlet 308 and/or the outlet section 324 of an adjacent joint 304. Similarly, while the outlet section 324 is shown as a spherical structure, according to other exemplary embodiments, the outlet section 324 may have other shapes configured to engage the wall carrier 332 or the inlet section 322 of an adjacent joint 304, forming a sealed engagement therebetween.

While FIG. 12 shows the plurality of joints 304 coupled to the upper trapway outlet 308, according to other exemplary embodiments, the plurality of joints 304 may be directly coupled to the discharge pipe outlet 26, without an upper trapway outlet 308 disposed therebetween. In this configuration, when a center axis of the discharge pipe outlet 26 is substantially horizontal (e.g., parallel to a central axis of the wall carrier 332), the plurality of joints 304 may form a generally "S" shaped path. FIG. 12 shows the trapway assembly 300 having four joints 304, although according to other exemplary embodiments, the trapway assembly 300 may include more or fewer joints. For example, the variety of possible path shapes may increase as the number of joints 304 is increased. While each of the joints 304 as shown include the same geometry, according to other exemplary embodiments, each of the joints 304 may have different shapes. For example, the shapes and sizes of the joint inlets 316, joint outlets 318, and passages 320 may vary between different joints 304.

According to an exemplary embodiment, the trapway assembly 300 may be installed on a toilet 2 by coupling an upstream-most joint 304 to the upper trapway outlet 308 and the downstream-most joint 304 to the wall carrier 332 while the toilet 2 is spaced apart from the wall 16. The toilet 2 is then moved toward the wall 16, causing the joints 304 to pivot within the adjacent joints 304 until the toilet 2 is disposed against the wall 16. When the toilet 2 is spaced apart from the wall 16, the trapway assembly 300 forms a substantially straighter path between the upper trapway outlet 308 and the wall carrier 332. When the toilet 2 is disposed against the wall 16, the joints 304 may form a substantially curved path. For example, the trapway assembly, including the plurality of joints and the upper trapway 302 may form a substantially "S" shaped path.

Figure 13:
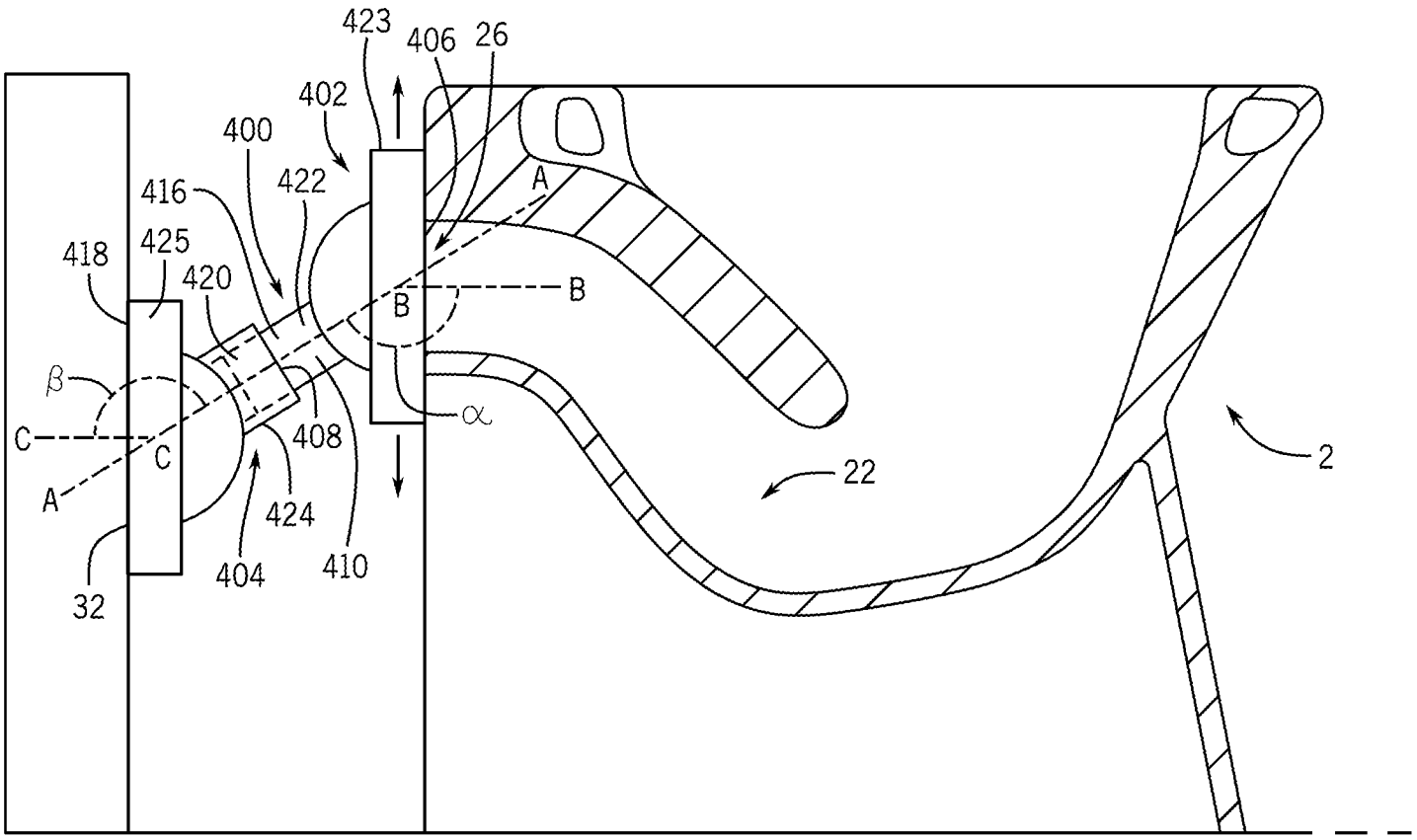
FIG. 13 is a side elevation view of an adjustable trapway assembly according to an exemplary embodiment.

Referring now to FIG. 13, a trapway assembly 400 is shown according to an exemplary embodiment. The trapway assembly 400, which includes an upper trapway 402 and a lower trapway 404 separately formed from the upper trapway 402, is configured to fluidly couple the discharge pipe outlet 26 to the wall carrier 32. The upper trapway 402 defines an upper trapway inlet 406 (i.e., inlet, first end, upstream end, etc.) and an upper trapway outlet 408 (i.e., outlet, second end, downstream end, etc.). The upper trapway 402 forms an upper extension section 422 having a passage 410 extending between the upper trapway inlet 406 and the upper trapway outlet 408. According to an exemplary embodiment, the passage 410 proximate the upper trapway inlet 406 defines an inner diameter substantially the same as an inner diameter of the discharge pipe outlet 26 or other configurations, such that the flow of fluid from the discharge pipe 22 to the upper trapway 402 is not restricted.

The lower trapway 404 defines a lower trapway inlet 416 (i.e., inlet, first end, upstream end, etc.) and a lower trapway outlet 418 (i.e., outlet, second end, downstream end, etc.). The lower trapway 404 forms a lower extension section 424 having a passage 420 extending between the lower trapway inlet 416 and the lower trapway outlet 418. The lower trapway inlet 416 defines an inner diameter that is substantially the same as or greater than an outer diameter of the upper trapway outlet 408, such that the lower trapway inlet 416 is configured to receive the upper trapway outlet 408 therein. According to other exemplary embodiments, the lower trapway inlet 416 defines an outer diameter that is substantially the same as or less than in inner diameter of the upper trapway outlet 408, such that the upper trapway outlet 408 is configured to receive the lower trapway inlet 416 therein.

The upper extension section 422 may be coupled to or integrally formed with an upper mounting bracket 423, configured to couple the upper trapway 402 to the toilet 2 at the discharge outlet 26. For example, the upper mounting bracket 423 may be configured to couple the upper trapway 402 to the toilet 2 in substantially the same way as the lower trapway 44 is coupled to the wall carrier 32, although according to other exemplary embodiments, the upper trapway 402 may be coupled to the toilet 2 in other ways. The passage 410 extends through the upper extension section 422 and the upper mounting bracket 423, forming a fluid connection between the discharge pipe outlet 26 to the upper trapway outlet 408. The upper extension section 422 defines a central axis A-A extending through the passage 410, which is offset by an angle $\alpha$ from a central axis B-B defined by the upper trapway inlet 406 at the upper mounting bracket 423 and/or the discharge pipe outlet 26. The upper extension section 422 may extend from the upper mounting bracket 423 at a fixed angle $\alpha$, such that the upper extension section 422 maintains a constant orientation relative to the upper mounting bracket 423, regardless of a position of the toilet 2 for installation on the wall carrier 32. According to another exemplary embodiment, the upper extension section 422 may be fluidly coupled to the upper mounting bracket 423 with a pivoting joint. In this configuration, the angle $\alpha$ between the upper extension section 422 and the upper trapway inlet 406 may vary as the toilet 2 is installed on the wall carrier 32.

The lower extension section 424 may be coupled to or integrally formed with a lower mounting bracket 425, configured to couple the lower trapway 404 to the wall carrier 32. For example, the lower mounting bracket 425 may be configured to couple the lower trapway 404 to the wall carrier 32 in substantially the same way as the lower trapway 44 is coupled to the wall carrier 32 as shown in FIG. 2, although according to other exemplary embodiments, the lower trapway 404 may be coupled to the wall carrier 32 in other ways. The passage 420 extends through the lower extension section 424 and the lower mounting bracket 425, forming a fluid connection between the lower trapway inlet 416 and the wall carrier 32. The lower extension section 424 further defines the central axis A-A (e.g., the upper extension section 422 and the lower extension section 424 define a substantially collinear central axis A-A) extending through the passages 410, 420, which is offset by an angle $\beta$ from a central axis C-C defined by the lower trapway outlet 418 at the lower mounting bracket 425 and/or the wall carrier 32. The lower extension section 424 may extend from the lower mounting bracket 425 at a fixed angle $\beta$, such that the lower extension section 424 maintains a constant orientation relative to the lower mounting bracket 425, regardless of a position of the toilet 2 for installation on the wall carrier 32. According to another exemplary embodiment, the lower extension section 424 may be fluidly coupled to the lower mounting bracket 425 with a pivoting joint. In this configuration, the angle $\beta$ between the lower extension section 424 and the lower trapway outlet 418 may vary as the toilet 2 is installed on the wall carrier 32.

As discussed above, the upper extension section 422 is received in the lower extension section 424, fluidly coupling the upper trapway 402 and the lower trapway 404. The upper extension section 422 and lower extension section 424 are telescopically coupled, such that the upper extension section 422 slides coaxially within the lower extension section 424 (e.g., along axis A-A) as the toilet 2 is moved during installation. For example, when the toilet 2 is moved vertically upward and/or horizontally away from the wall carrier 32, less of the upper extension section 422 is received in the lower extension section 424, while maintaining a fluid connection. Similarly, when the toilet 2 is moved vertically downward and/or horizontally toward the wall carrier 32, more of the upper extension section 422 is received in the lower extension section 424. According to an exemplary embodiment, the telescopic coupling may be maintained where the lower extension section 424 is received in the upper extension section 422.

Figure 14:
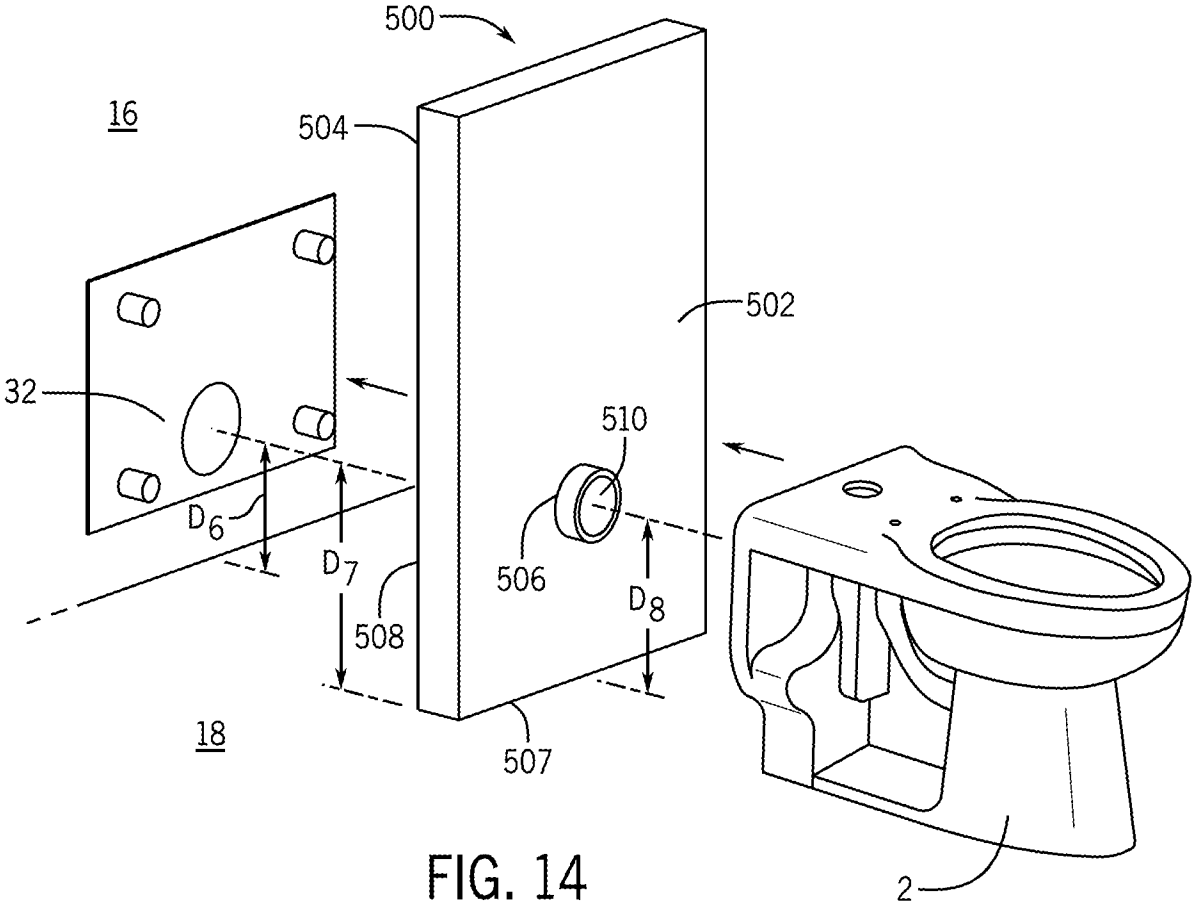
FIG. 14 is an exploded perspective view of an adjustable trapway adapter according to an exemplary embodiment.

Referring now to FIG. 14, a trapway adapter 500 is shown according to an exemplary embodiment. The trapway adapter 500 includes a trapway inlet 506 extending from a front (i.e., first, upstream, etc.) side 502, thereof. The trapway inlet 506 is configured to be fluidly coupled to the discharge pipe outlet 26. The trapway adapter 500 defines a passage extending from the trapway inlet 506 to a trapway outlet 508 on an opposing, rear (i.e., second, downstream, etc.) side 504 of the trapway adapter 500. The trapway outlet 508 is configured to be fluidly coupled to the wall carrier 32. As shown in FIG. 14, the trapway inlet 506 is disposed at a height $D_4$ above a lower edge 507 of the trapway adapter 500. This height $D_4$ may be substantially the same as a height $D_5$ of the discharge pipe outlet 26 above the floor 18. In this configuration, the trapway adapter 500 may rest on the floor 18, such that the trapway inlet 506 may be fluidly coupled to the discharge pipe outlet 26. According to other exemplary embodiments, the trapway adapter 500 may be mounted to the wall 16, such that the lower edge 507 is raised above (i.e., spaced apart) from the floor 18. A vertical position of the trapway adapter 500 on the wall may be selected, such that the trapway inlet 506 is at substantially the same height as the discharge pipe outlet 26 once the trapway adapter 500 is installed on the wall 16.

The trapway adapter 500 may be in a pre-determined configuration for pairing with a specific toilet 2, having a discharge pipe outlet 26 with a pre-determined height. For example, the trapway adapter 500 and the toilet 2 may be provided as a set. Furthermore, a height of the trapway outlet 508 may be pre-determined for a given trapway adapter 500. For example, where a height $D_6$ of the wall carrier 32 above the floor 18 is known, a trapway adapter 500 having the trapway outlet 508 at a pre-determined height $D_7$ above the lower edge 507 may be provided. This configuration may be advantageous where the heights of various wall carriers 32 are known to be within a set of substantially discrete heights $D_6$. For example, conventional wall-mounted toilets and ADA-compliant wall-mounted toilets may be positioned at heights required by government agencies or other bodies. In this example, there are two different known heights $D_6$ of the corresponding wall carriers 32, such that two different trapway adapters 500 may be configured to accommodate all of the conventional and ADA-compliant toilet conversions.

Figure 15:
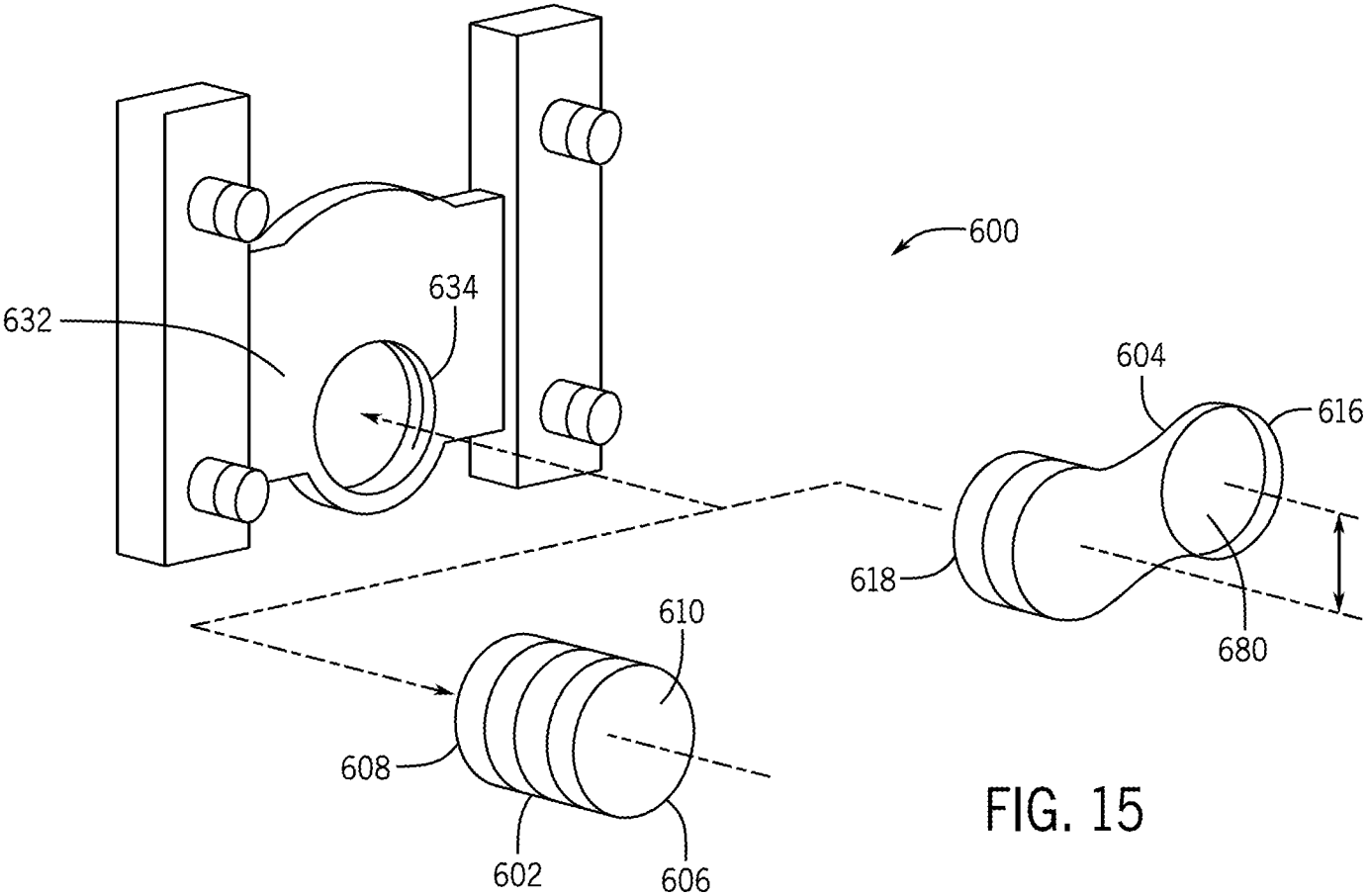
FIG. 15 is an exploded perspective view of an adjustable trapway assembly according to an exemplary embodiment.
Figure 16:
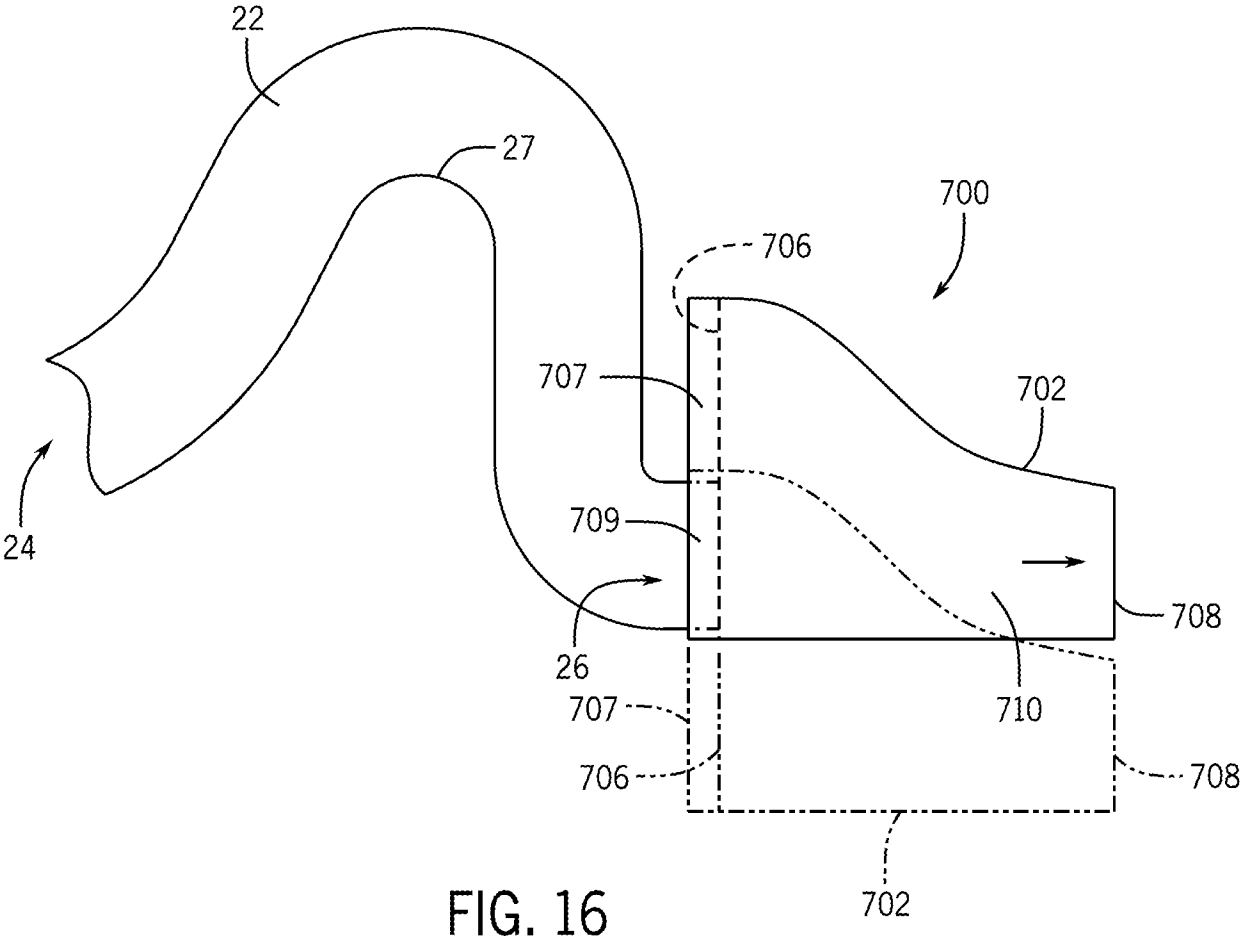
FIG. 16 is a side elevation view of an adjustable trapway assembly according to an exemplary embodiment.
Figure 17:
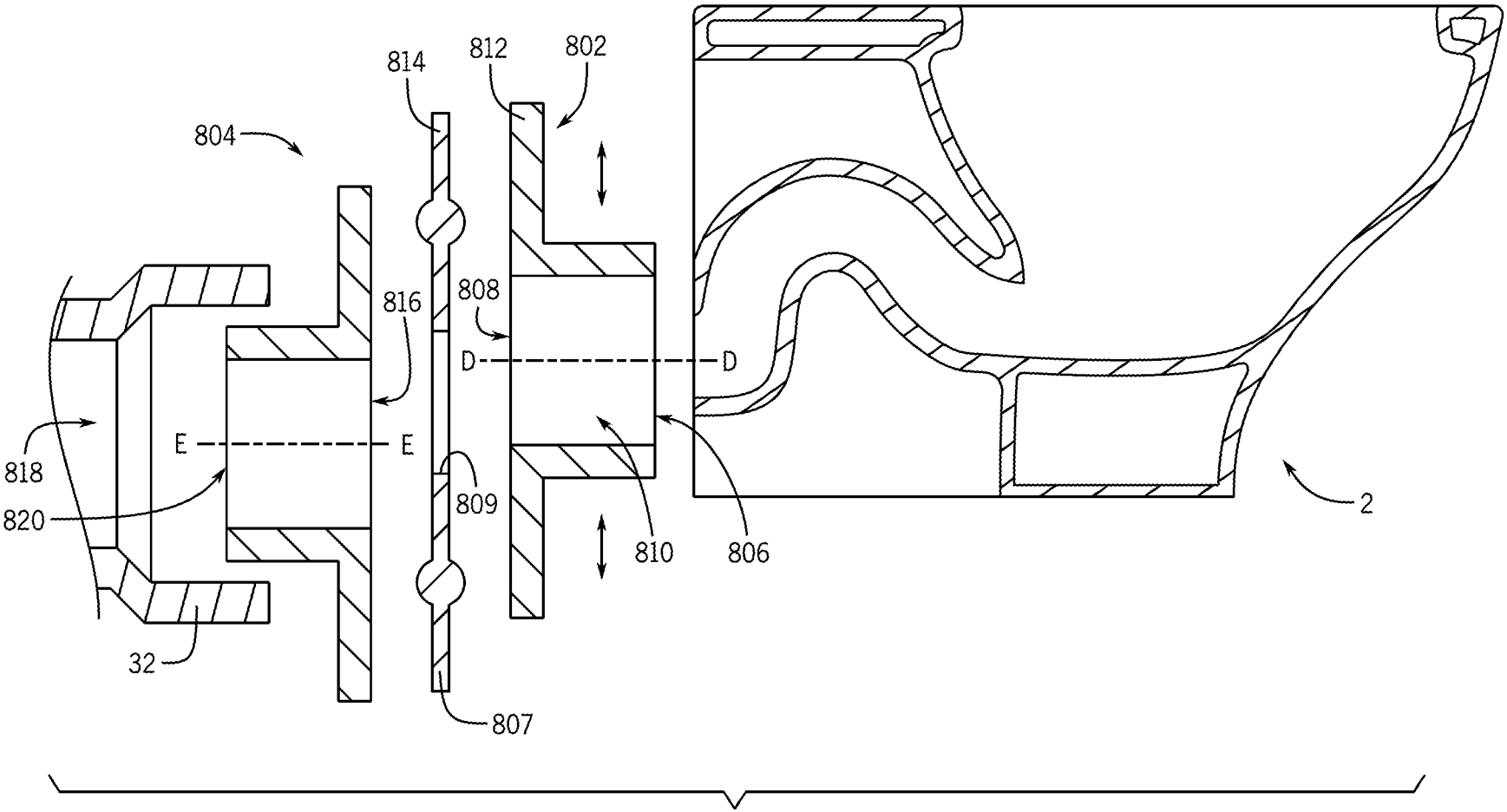
FIG. 17 is a cross-sectional view of an adjustable trapway assembly according to an exemplary embodiment.

With the trapway inlet 506 and the trapway outlet 508 at different pre-determined heights, the passage 510 extending therebetween may define a non-horizontal central axis. The passage 510 may be substantially linear or non-linear. According to other exemplary embodiments, the trapway adapter 500 is configured to have a trapway outlet 508 with an adjustable height, such that a single configuration for a trapway adapter 500 may be adaptable to fluidly couple to wall carriers 32 at varying heights. Examples of this adjustable configuration are shown in FIGS. 15-17, as will be described in further detail below. The passage 510 may be substantially horizontal or non-horizontal depending on the configuration of the trapway outlet 508.

Referring now to FIG. 15, a trapway assembly 600 is shown according to an exemplary embodiment. A wall carrier 632 is disposed in the wall 16 and may be substantially the same as the wall carrier 32 as described above. As shown in FIG. 15, the wall carrier 632 defines a threaded opening 634 extending therethrough for coupling to one of a first trapway 602 or a second trapway 604. The first trapway defines a first trapway inlet 606 (i.e., inlet, first end, upstream end, etc.) and a first trapway outlet 608 (i.e., outlet, second end, downstream end, etc.). At least a portion of the first trapway 602 proximate to the first trapway outlet 608 is externally threaded and configured to be received in and threadably coupled to the threaded opening 634 in the wall carrier 632. As shown in FIG. 15, the first trapway 602 may include a substantially straight passage 610, such that a height of first trapway inlet 606 is positioned at substantially the same height as the threaded opening 634 of the wall carrier 632 above the floor 18. In this configuration, the wall carrier 632 may be fluidly coupled to a replacement toilet 2 having a drain passage outlet 26 at a height above the floor 18 substantially the same as the height of the wall carrier 632.

Referring still to FIG. 15, the second trapway 604 defines a second trapway inlet 616 (i.e., inlet, first end, upstream end, etc.) and a second trapway outlet 618 (i.e., outlet, second end, downstream end, etc.). At least a portion of the second trapway 604 proximate to the second trapway outlet 618 is externally threaded and configured to be received in and threadably coupled to the threaded opening 634 in the wall carrier 632. The second trapway 604 forms a non-linear passage 620, such that a height of the second trapway outlet 618 above the floor 18 may be different than the height of the threaded opening 634 of the wall carrier 632. For example, when the threaded portion of the second trapway 604 is received in the threaded opening 634, the height of the second trapway inlet 616 is either above or below the height of the second trapway outlet 618 in the threaded opening 634. The second trapway inlet 616 may be fluidly coupled to the discharge pipe outlet 26. In this configuration, the wall carrier 632 may be fluidly coupled to a replacement toilet 2 having a drain passage outlet 26 at a height above the floor 18 different than the height of the wall carrier 632.

While FIG. 15 shows only one example of the second trapway 604, according to other exemplary embodiments, the second trapway 604 may form a passage 620 having other shapes. For example, where the heights of the wall carrier 632 and the discharge pipe outlet 26 are pre-determined, the passage 620 of the second trapway 604 may be configured to provide the second trapway outlet 618 and second trapway inlet 616 at corresponding heights, respectively. For example, a manufacturer may produce more than one version of the second trapway 604 having passages 620 with varying geometries, such that the second trapway 604 is selected based on the height of the wall carrier 632 and the height of the discharge pipe outlet 26 of a desired toilet 2 for installation.

Advantageously, when the wall carrier 632 is initially installed in the wall 16, the wall carrier 632 is configured to be coupled to either of the first or second trapways 602, 604. In this configuration, the same wall carrier can be easily coupled to both a wall-mounted toilet with the first trapway 602 or a floor-mounted toilet with the second trapway 604 without having to modify the wall carrier 632. A bathroom may be constructed with the flexibility of selecting whether to install wall-mounted or floor-mounted toilets at a later date after the wall carrier 632 is installed and enclosed in the wall 16.

According to an exemplary embodiment, a method of replacing a toilet includes removing a wall-mounted toilet from the wall 16 and removing the first trapway 602 from the threaded opening 634 of the wall carrier 632. The method further includes determining (e.g., measuring) the height of the threaded opening 634 and the height of the discharge pipe outlet 26 of the floor-mounted replacement toilet 2 above the floor 18. An installer may select a second trapway 604 based on these heights and install the threaded portion of the second trapway 604 in the threaded opening 634. The second trapway inlet 616 may then be fluidly coupled to the discharge pipe outlet 26.

Referring now to FIG. 16, a trapway assembly 700 is shown according to an exemplary embodiment. The trapway assembly 700 includes a trapway 702 defining a trapway inlet 706 (i.e., inlet, first end, upstream end, etc.), a trapway outlet 708 (i.e., outlet, second end, downstream end, etc.), and a passage 710 extending therebetween. The trapway inlet 706 may define a larger cross-sectional area than the trapway outlet 708. For example, the trapway inlet 706 may define a vertically elongated opening. The trapway outlet 708 may be configured to be received in and fluidly coupled to the wall carrier 32 at a fixed height above the floor 18. For example, the trapway 702 may be fluidly coupled to the wall carrier 32 in substantially the same way as the lower trapway 44 shown in FIG. 2 (e.g., with a mounting plate 54), although according to other exemplary embodiments, the trapway 702 may be coupled to the wall carrier 32 in other ways. A gasket 707 is disposed at the trapway inlet 706, such that the discharge pipe outlet 26 is fluidly coupled to the trapway 702 through the gasket 707. For example, the gasket 707 may define an opening 709 extending therethrough. The opening 709 may be configured to receive the drain passage outlet 26 therein or the drain passage outlet 26 may be coupled to an external surface of the gasket 707 opposite the trapway 702. As shown in FIG. 16, the discharge pipe outlet 26 may be received by the gasket 707 at different heights. For example, the trapway 702 is shown at two different heights (e.g., one height is shown in solid lines and another height is shown in dashed lines) relative to the discharge pipe outlet 26. The gasket 707 shown in solid lines includes the opening 709 disposed at an lowermost end of the trapway inlet 706. The gasket shown in dashed lines includes the opening 709 disposed at an uppermost end of the trapway inlet 706. According to other exemplary embodiments, the opening 709 may be disposed at any position between the uppermost and lowermost ends of the trapway inlet 706.

While the trapway inlet 706 may be disposed at a fixed height above the floor 18, the opening 709 in the gasket 707 may be configured to be positioned at a desired height corresponding with the height of the discharge pipe outlet 26 above the floor 18. As discussed with respect to FIG. 2, discharge pipe outlet 26 is disposed at a position higher than the discharge pipe inlet 24 and the sump 20. For example, the discharge pipe outlet 26 may be disposed at an uppermost portion of the discharge pipe 22. As shown in FIG. 16, the discharge pipe outlet 26 may be disposed below the uppermost portion of the discharge pipe 22, forming a weir 27 between the discharge pipe inlet 24 and the discharge pipe outlet 26. In this configuration, the discharge pipe 22 may provide a water seal without requiring the trapway assembly 700. The gasket 707 is configured to be coupled to the discharge pipe outlet 26 at a variety of heights.

According to an exemplary embodiment, the gasket 707 may be provided as a substantially solid piece of material (e.g., rubber, or other material configured to maintain sealed engagement between the discharge pipe outlet 26 and the trapway inlet 706). A user may drill a hole in the gasket 707, forming the opening 709. A diameter of the opening 709 may be substantially the same as or smaller than a diameter of the discharge pipe outlet 26 for forming the sealed engagement therewith. According to another exemplary embodiment, the gasket 707 may be provided with the opening 709 already formed at a pre-determined location in the gasket 707. For example, where the heights of the discharge pipe outlet 26 and the wall carrier 32 are predetermined, a gasket 707 may be selected, such that when the trapway outlet 708 is coupled to the wall carrier 32 and the gasket 707 is installed on the trapway 702, the opening 709 is at substantially the same height as the discharge pipe outlet 26. In this configuration, a manufacturer may provide multiple versions of the gasket 707 with the opening 709 disposed at different locations, such that a user may select a gasket 709 corresponding with the heights of the wall carrier 32 and the discharge pipe outlet 26. According to another exemplary embodiment, the gasket 707 may define a height that is greater than a height of the trapway inlet 706. In this configuration, the gasket 707 may be disposed on the trapway inlet 706 and repositioned vertically until the opening 709 of the gasket 707 is disposed at the same height as the discharge pipe outlet 26. According to another exemplary embodiment, each of the gasket 707 and the trapway inlet 706 may be substantially circular. In this configuration, the gasket 707 may be rotated until the opening 709, which is disposed toward an outer edge of the gasket 707, is aligned with the discharge pipe outlet 26. The toilet 2 may be disposed laterally offset (e.g., side to side, transverse, etc.) from the wall carrier 32 where the gasket 707 is oriented, such that the opening 709 is not at its uppermost or lowermost position (e.g., 12:00 or 6:00 positions).

Referring now to FIG. 17, a trapway assembly 800 is shown according to an exemplary embodiment. The trapway assembly 800, which includes a first trapway 802 and a second trapway 804 separately formed from the first trapway 802, is configured to fluidly couple the discharge pipe outlet 26 to the wall carrier 32. The first trapway 802 defines an first trapway inlet 806 (i.e., inlet, first end, upstream end, etc.) and a first trapway outlet 808 (i.e., outlet, second end, downstream end, etc.). A first flange 812 extends substantially radially outward from the first trapway 802 at the first trapway outlet 808. The first trapway 802 defines a generally linear passage 810 extending between the first trapway inlet 806 and the first trapway outlet 808. The passage 810 is configured to be fluidly coupled to the discharge pipe outlet 26. According to an exemplary embodiment, the passage 810 proximate the upper trapway inlet 106 defines an inner diameter substantially the same as an inner diameter of the discharge pipe outlet 26 or other configurations, such that the flow of fluid from the discharge pipe 22 to the first trapway 802 is not restricted.

The second trapway 804 defines a second trapway inlet 816 (i.e., inlet, first end, upstream end, etc.) and a second trapway outlet 818 (i.e., outlet, second end, downstream end, etc.). A second flange 814 extends substantially radially outward from the second trapway 804 at the second trapway inlet 816. The second trapway 804 defines a generally linear passage 820 extending between the second trapway inlet 816 and the second trapway outlet 818. The second trapway 804 may be fluidly coupled to the wall carrier 32 in substantially the same way as the lower trapway 44 shown in FIG. 2 (e.g., with a mounting plate 54), although according to other exemplary embodiments, the second trapway 804 may be coupled to the wall carrier 32 in other ways.

A gasket 807 may be disposed between the first flange 812 and the second flange 814 and define an opening 809 extending therethrough. The gasket 807 may be similar to or different from the gasket 707 as described with respect to FIG. 16. When the first trapway 802 and the second trapway 804 are brought together, the gasket 807 may be compressed between the first and second flanges 812, 814, sealing the trapway assembly 800. The passage 810 of the first trapway 802 and the passage 820 of the second trapway 804 may be fluidly coupled through the opening 809 of the gasket 807. The opening 809 may be the same as or greater than the inner diameters of the passages 810, 820.

The passage 810 defines a central axis D-D substantially coaxial with a central axis of the discharge pipe outlet 26. The passage 820 defines a central axis E-E substantially coaxial with a central axis of the wall carrier 32 and parallel to and offset from the central axis D-D. According to an exemplary embodiment, the first trapway outlet 808 and the second trapway inlet 816 overlap, providing a fluid connection therebetween. For example, the lowermost point of the first trapway outlet 808 may be disposed below the uppermost point of the second trapway inlet 816. Similarly, the uppermost point of the first trapway outlet 808 may be disposed above the lowermost point of the second trapway inlet 816. According to another exemplary embodiment, the diameter of the first trapway outlet 808 may be greater than the first trapway inlet 806 and the diameter of the second trapway inlet 816 may be greater than the second trapway outlet 818. According to another exemplary embodiment, the passages 810, 820 may define other geometries. For example, the central axes D-D and E-E may define other non-linear shapes and/or may define other orientations that are not generally parallel.

Figure 18A:
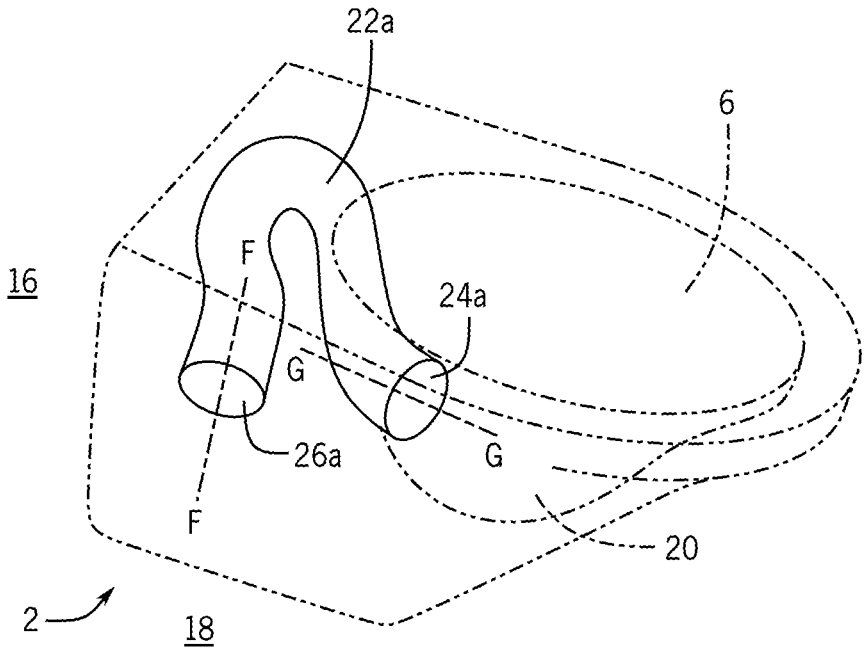
FIG. 18A is a perspective view of a trapway according to an exemplary embodiment.

Referring now to FIG. 18A, a discharge pipe 22 for a toilet 2 is shown according to various exemplary embodiments. As discussed above, the discharge pipe 22 includes a discharge pipe inlet 24 disposed at the sump 20 and a discharge pipe outlet 26. While FIG. 2 shows the discharge pipe outlet 26 substantially parallel to the wall 16 and defining a central axis F-F substantially parallel to a central axis G-G of the discharge pipe inlet 24. In contrast to the orientation of the discharge pipe outlet 26 as shown in FIG. 2, the central axis F-F of the discharge pipe outlet 26 may be oriented in other angles relative to either or both of the wall carrier 32 and the discharge pipe inlet 24.

A discharge pipe 22*a* is shown according to an exemplary embodiment. The central axis F-F for the discharge pipe outlet 26*a* is shown offset at an angle from the floor 18. For example, the central axis F-F may extend away from the floor 18 at an angle of approximately between 35 degrees and 50 degrees. In this configuration, the discharge pipe outlet 26*a* may be coupled to a trapway as described above, such that the trapway inlet defines an axis that is neither parallel nor perpendicular to the floor 18. According to an exemplary embodiment, the central axis F-F may be substantially parallel to the wall 16. For example, the discharge pipe 22*a* proximate to the discharge pipe inlet 24*a* may extend in a generally fore-aft (e.g., from the bowl 6 to the wall 16) orientation and the discharge pipe 22*a* proximate to the discharge pipe outlet 26*a* may extend in a generally lateral (i.e., side to side, etc.) orientation. In this configuration, the central axis G-G may be substantially perpendicular to the wall 16 and define an angle (e.g., approximately 90 degrees) between the central axis F-F and the central axis G-G, although other angles may be defined according to other exemplary embodiments.

Figure 18B:
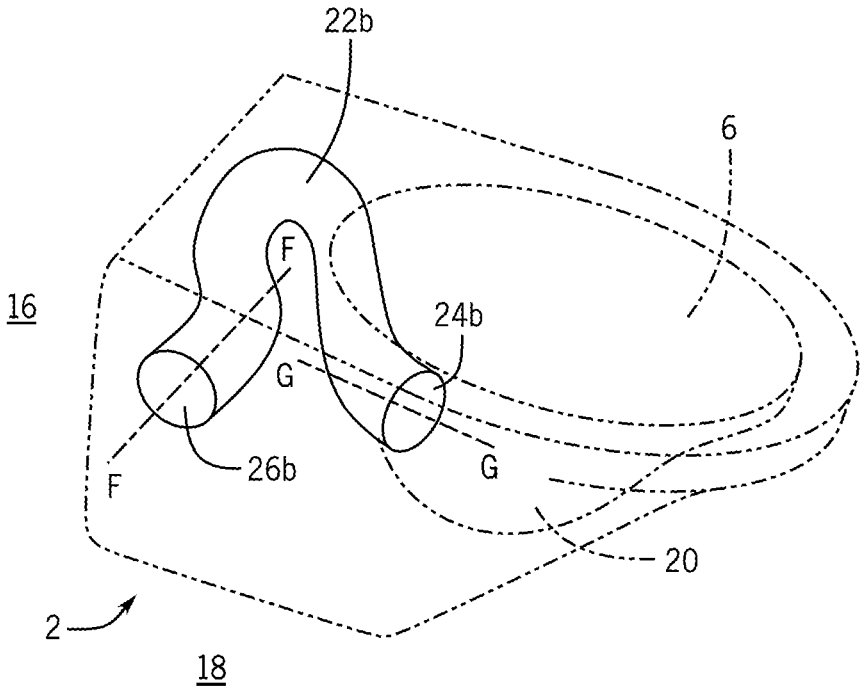
FIG. 18B is a perspective view of a trapway according to an exemplary embodiment.

Referring now to FIG. 18B, another discharge pipe 22*b* is shown according to an exemplary embodiment. The central axis F-F for the discharge pipe outlet 26*b* is shown substantially parallel to the floor 18. The central axis F-F may be substantially parallel to the wall 16. The central axis G-G may be substantially perpendicular to the wall 16 and define an angle (e.g., approximately 90 degrees) between the central axis F-F and the central axis G-G, although other angles may be defined according to other exemplary embodiments. For example, the discharge pipe 22*b* proximate to the discharge pipe inlet 24*b* may extend in a generally fore-aft (e.g., from the bowl 6 to the wall 16) orientation and the discharge pipe 22*b* proximate to the discharge pipe outlet 26*b* may extend in a generally lateral (i.e., horizontal, side to side, etc.) orientation. In this configuration, the discharge pipe outlet 26*b* may be coupled to a trapway as described above, such that the trapway inlet defines an axis that is parallel to the floor 18 and parallel to the wall 16. In either of the configurations of discharge pipes 22*a*, 22*b* shown in FIGS. 18A and 18B or other possible configurations of the discharge pipe 22, the various trapway assemblies or adapters as discussed above may be configured to be fluidly coupled to the discharge pipe outlet 26, 26*a*, 26*b*.

Figure 19:
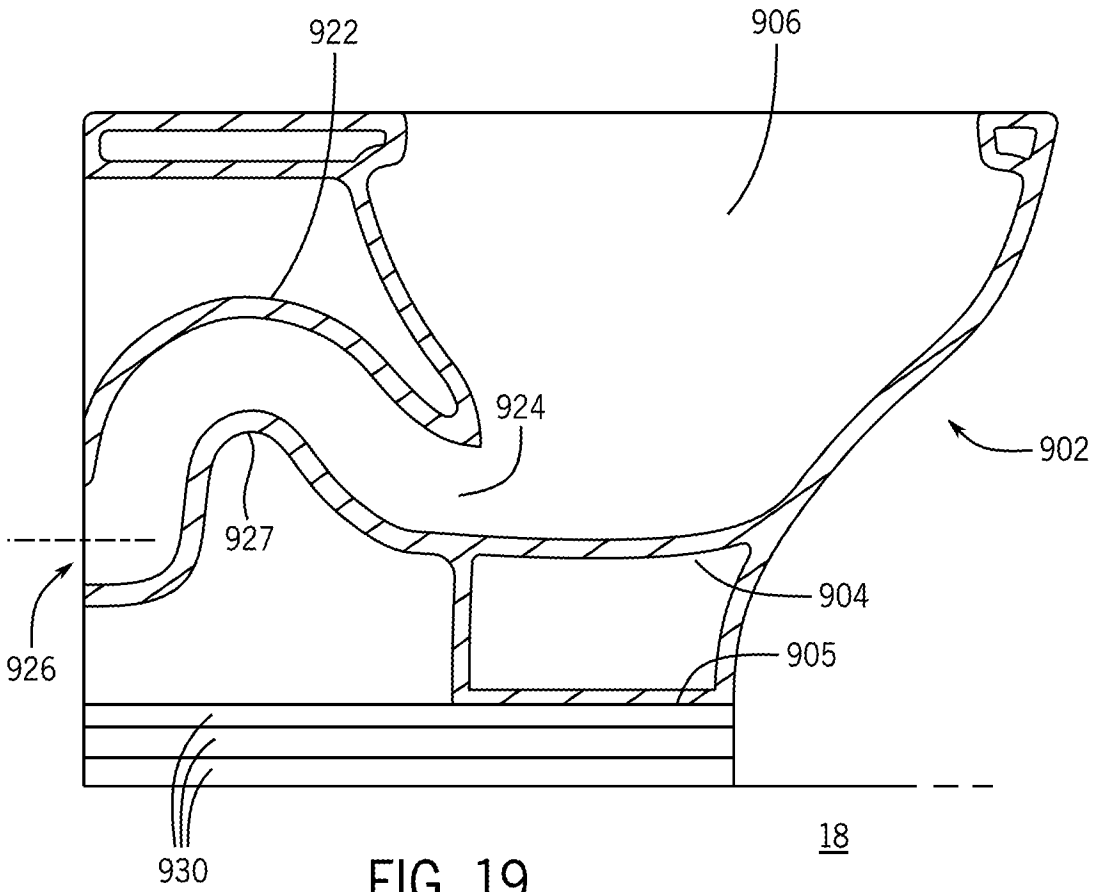
FIG. 19 is a side elevation view of an adjustable toilet assembly according to an exemplary embodiment.

Referring now to FIG. 19, an adjustable toilet assembly 900 is shown according to an exemplary embodiment. The toilet assembly 900 includes a floor-mounted (i.e., pedestal) toilet 902, including a base 904, defining a lower edge 905, and a bowl 906. The base 904 is positioned, at least in part, below the bowl 906 and is configured to support a load provided on the bowl 906. A discharge pipe 922 defines a discharge pipe inlet 924 (i.e., inlet, first end, upstream end, etc.) and a discharge pipe outlet 926 (i.e., outlet, second end, downstream end, etc.) at opposing ends thereof. The discharge pipe outlet 926 may be disposed below the uppermost portion of the discharge pipe 922, forming a weir 927 between the discharge pipe inlet 924 and the discharge pipe outlet 926. As shown in FIG. 19, the discharge pipe outlet 926 may be fluidly coupled to the wall carrier 32 for transferring waste from the toilet 902. According to an exemplary embodiment, the discharge pipe 922 may be integrally formed with the toilet 902. According to another exemplary embodiment, the toilet 902 may be substantially the same as the toilet 2 shown in FIGS. 1 and 2 and configured to house a trapway assembly, as discussed above.

As shown in FIG. 19, the toilet assembly 900 may include a plurality of shims 930 disposed below the lower edge 905 of the base 904, between the toilet 902 and the floor 18. The shims 930 may be placed on the floor 18, having a profile complementary to and configured to receive the lower edge 905 of the toilet 902. One or more shims 930 may be provided to space the toilet 902 away from the floor 18, raising the position of the discharge pipe outlet 926. The shims 930 may be provided in varying or constant thicknesses. For example, when a height of the wall carrier 32 above the floor 18 is known (e.g., pre-determined), a shim 930 or a plurality of shims 930 may be provided having a total thickness sufficient to raise the discharge pipe outlet 926 above the floor 18 to the corresponding height of the wall carrier 32. The total thickness of the shims 930 may be the substantially the same as the height of the wall carrier 32 above the floor 18 less a height of the discharge pipe outlet 926 over the lower edge 905 of the base 904.

Figure 20:
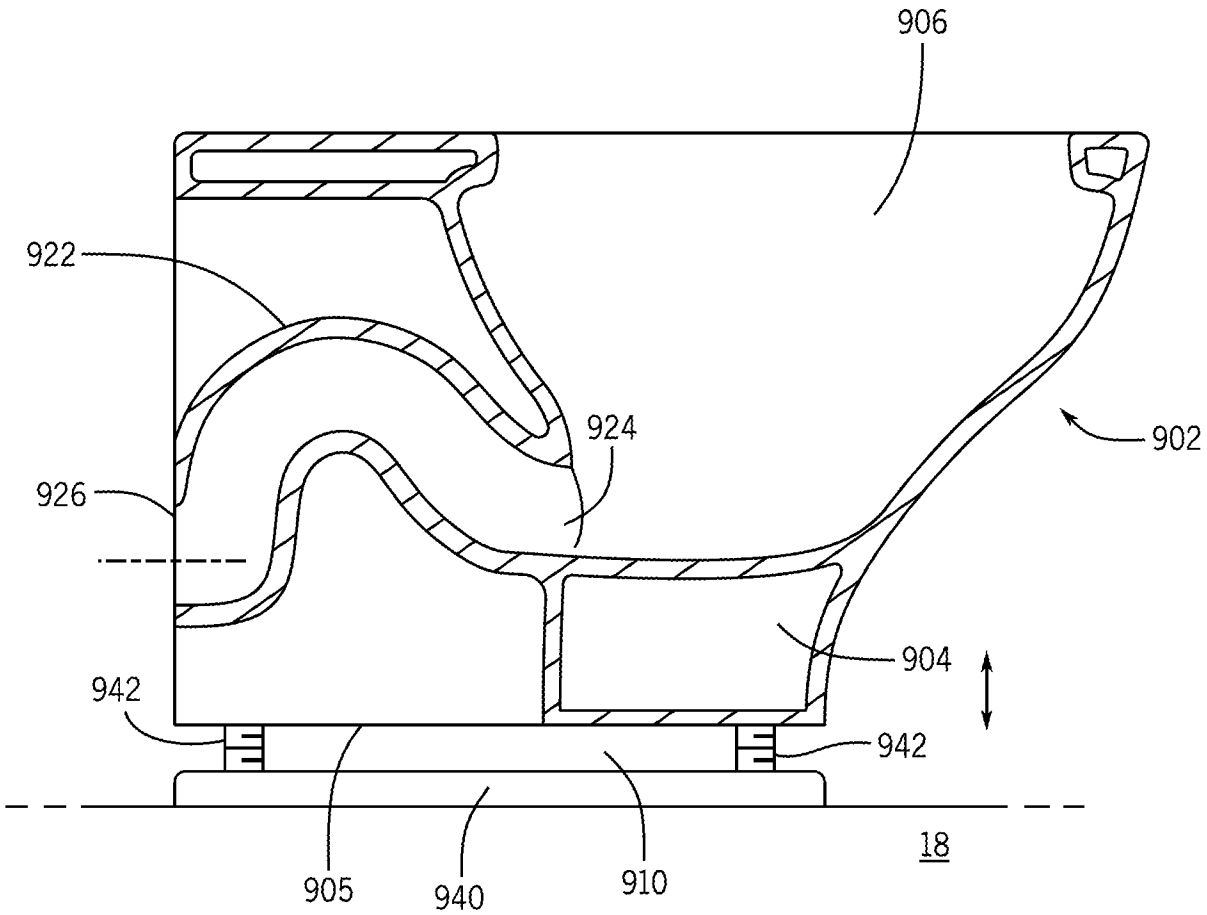
FIG. 20 is a side elevation view of an adjustable toilet assembly according to an exemplary embodiment.

Referring now to FIG. 20, the toilet assembly 900 is shown according to another exemplary embodiment. The toilet assembly 900 may include an adjustable foot 940 disposed at the lower edge 905 of the base 904. The foot 940 is coupled to the base 904 at the lower edge 905 with a threaded extension 942. For example, the externally-threaded extension 942 may be received in a corresponding internally-threaded opening in at least one of the base 904 or the foot 940. When each of the threaded extensions 942 are rotated in a first direction (e.g., clockwise or counterclockwise), they are further received in the threaded openings, bringing the foot 940 closer to the lower edge 905 of the base 904. In this configuration, the height of the toilet 902 above the floor 18 increases, thereby raising a height of the drain passage outlet 926 further from the floor 18. Similarly, when the threaded extensions 942 are rotated in a second direction opposite to the first direction (e.g., counterclockwise or clockwise, respectively), they are withdrawn, in part, from the threaded openings, until the foot 940 is spaced further apart from the lower edge 905. In this configuration, the height of the toilet 902 above the floor 18 decreases, thereby lowering the height of the drain passage outlet 926 further from the floor 18. The threaded extensions 942 may be positioned proximate to an outer periphery of the base 940 and/or toilet 902. While only two threaded extensions 942 are shown in FIG. 20, more or fewer threaded extensions 942 may extend between the foot 940 and the base 904 according to other exemplary embodiments. Furthermore, the threaded extensions 942 may be used to adjust the level (e.g., pitch or roll) of the toilet. For example, a forward threaded extensions 942 may be rotated in the first direction and a rearward threaded extension 942 may be rotated in the second direction, causing a forward end of the toilet 902 to rise or fall and a rear end of the toilet 902 to fall or rise, respectively. According to other exemplary embodiments, the foot 940 may be coupled to the toilet 902 in other ways such that the space between the toilet foot 940 and the toilet 902 may be adjusted.

Figure 21:
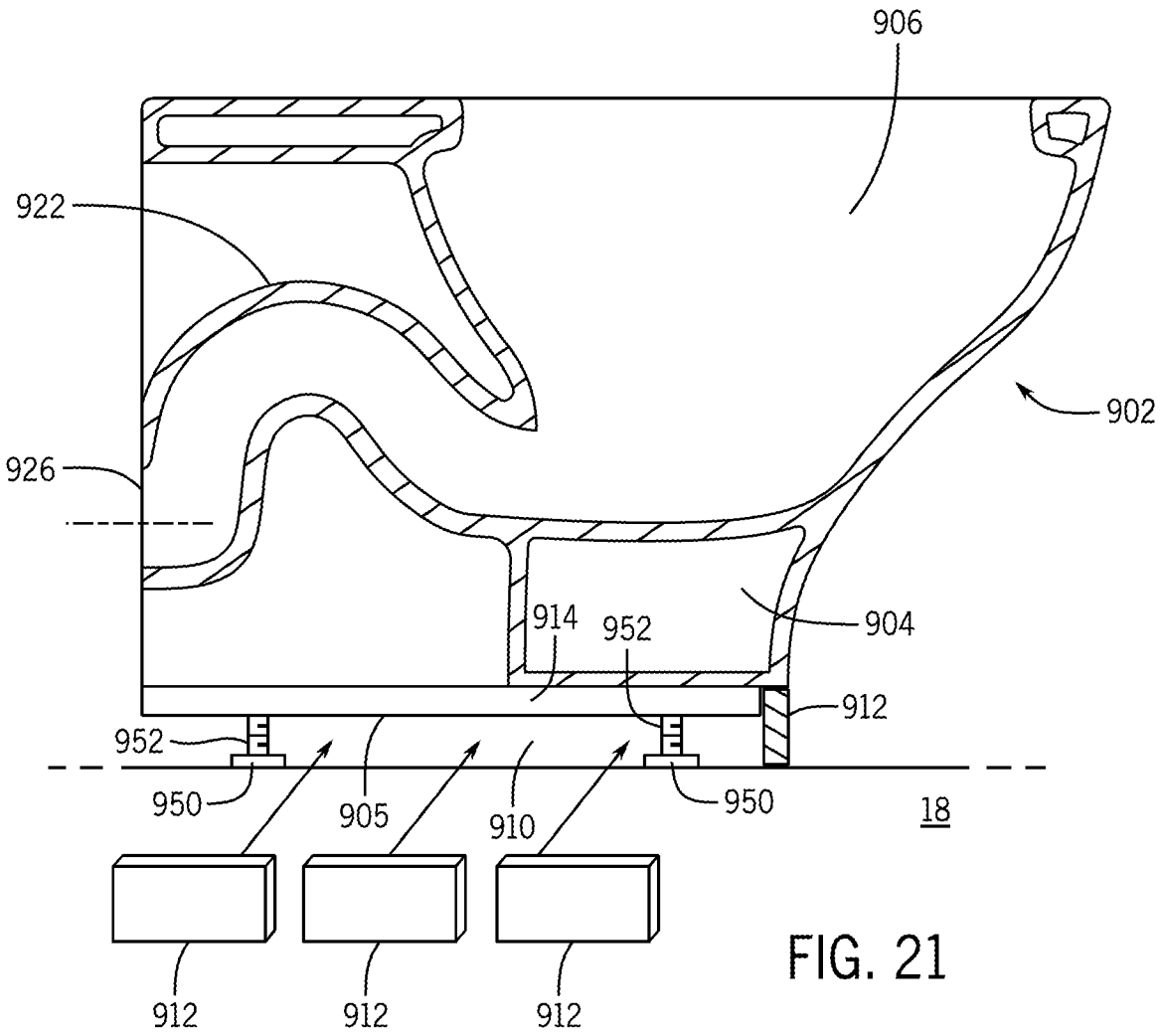
FIG. 21 is a side elevation view of an adjustable toilet assembly according to an exemplary embodiment.

Referring now to FIG. 21, the toilet assembly 900 is shown according to another exemplary embodiment. The toilet assembly 900 may include a plurality of adjustable feet 950 disposed at the lower edge 905 of the base 904. The feet 950 are coupled to the base 904 at the lower edge 905 with corresponding threaded extensions 952. For example, the externally-threaded extensions 952 may be received in corresponding internally-threaded openings in at least one of the base 904 or a foot 950. When the threaded extensions 952 are rotated in a first direction (e.g., clockwise or counterclockwise), they are further received in the threaded openings, bringing the feet 950 closer to the lower edge 905 of the base 904. In this configuration, the height of the toilet 902 above the floor 18 increases, thereby raising a height of the drain passage outlet 926 further from the floor 18. Similarly, when the threaded extensions 952 are rotated in a second direction opposite to the first direction (e.g., counterclockwise or clockwise, respectively), they are withdrawn, in part, from the threaded openings, until the feet 950 are spaced further apart from the lower edge 905. In this configuration, the height of the toilet 902 above the floor 18 decreases, thereby lowering the height of the drain passage outlet 926 further from the floor 18. The feet 950 may be positioned proximate to an outer periphery of the base 904 and/or toilet 902. While only two feet 950 are shown in FIG. 21, more or fewer feet 950 may be disposed at the base 904 according to other exemplary embodiments. Furthermore, the feet 950 may be used to adjust the level (e.g., pitch or roll) of the toilet. For example, a forward threaded extensions 952 for a forward foot 950 may be rotated in the first direction and/or a rearward threaded extension 952 for a rearward foot 950 may be rotated in the second direction, causing a forward end of the toilet 902 to rise or fall and a rear end of the toilet 902 to fall or rise, respectively. According to other exemplary embodiments, the feet 950 may be coupled to the toilet 902 in other ways such that the space between the feet 950 and the toilet 902 may be adjusted.

As shown in FIGS. 20 and 21, by engaging the feet 940, 950, a space 910 is defined between the feet 940, 950 and the lower edge 905 of the base 904. The feet 940, 950 may be concealed from view in order to provide a desired appearance and/or to limit access to the feet 940, 950 to prevent accidental adjustment of the toilet assembly 900, which may force the discharge pipe outlet 926 out of alignment with the wall carrier 32. As shown in FIG. 21, once the toilet assembly 900 is adjusted to provide the toilet 902 at the desired height above the floor 18, a plurality of tiles 912 may be coupled to the toilet, covering the space 910 defined between the lower edge 905 and the floor 18. The base 904 may include an inset portion 914, which provides a surface offset laterally inward into the base 904 proximate to the lower edge 905. In this configuration, the tiles 912 may be coupled to the base 904 at the inset portion 914, such that an outer surface of the tiles 912 are substantially flush with an outer surface of the base 904. The tiles 912 may be formed from ceramic, vitreous, or other durable material. For example, the tiles 912 may be formed from the same material as the toilet 902. According to other exemplary embodiments, the tiles 912 may be formed from other materials or have other colors, finishes, etc. based on a desired appearance. While FIG. 21 shows tiles 912 for concealing the space 910, other structures (e.g., shroud, caulk, etc.) and methods may be used to at least partially enclose the space 910.

Figure 22:
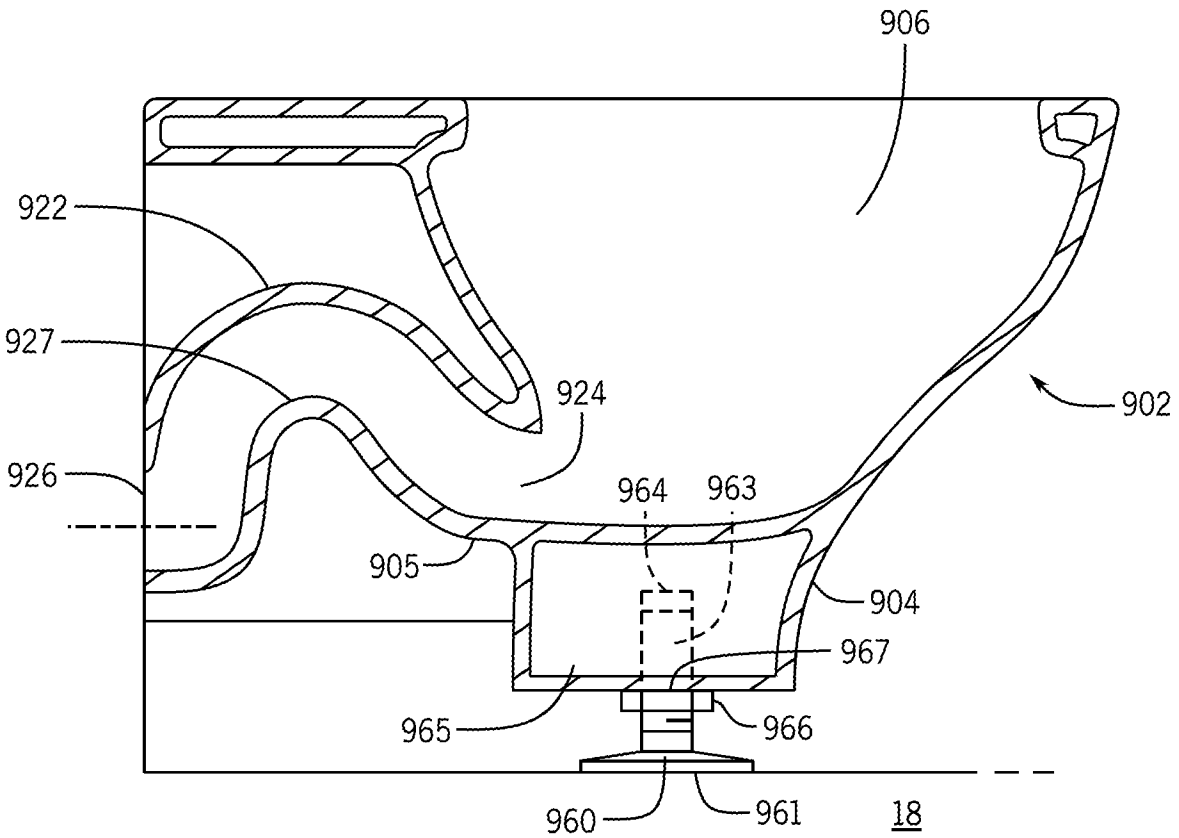
FIG. 22 is a side elevation view of an adjustable toilet assembly according to an exemplary embodiment.

Referring now to FIG. 22, the toilet assembly 900 is shown according to another exemplary embodiment. The toilet assembly 900 includes a foot 960 coupled to and extending downward from a socket 964, disposed at the lower edge 905 of the base 904. The socket 964 is integrally formed in the toilet 902 and is configured to receive an upward extension 962 defined by the foot 960. For example, the extension 962 may be externally threaded and the socket 964 may be internally threaded and configured to threadably engage the extension 962. In this configuration, a height of the toilet may be adjusted by rotating the extension 962 in the socket 964. For example, when the extension 962 is rotated in a first direction (e.g., clockwise or counterclockwise), it is further received in the socket 964, bringing a lower edge 961 of the foot 960 closer to the lower edge 905 of the base 904. In this configuration, the height of the toilet 902 above the floor 18 increases, thereby raising a height of the drain passage outlet 926 further from the floor 18. Similarly, when the extension 962 is rotated in a second direction opposite to the first direction (e.g., counterclockwise or clockwise, respectively), it is withdrawn, in part, from the socket 964, until the lower edge 961 of the foot 960 is spaced further apart from the lower edge 905. In this configuration, the height of the toilet 902 above the floor 18 decreases, thereby lowering the height of the drain passage outlet 926 further from the floor 18. Because the extension 962 is received within the socket 964, the foot 960 is prevented from accidentally being knocked out from under the toilet 902.

According to another exemplary embodiment, the extension 962 may not be threadably received in the socket 964. As shown in FIG. 22, a nut 966 may be coupled to and/or disposed about the extension 962 between an upper end 963 of the extension 962 and the lower edge 961 of the foot 960. The nut 966 defines an outer diameter that is greater than an inner diameter of the socket 964, such that when the extension 962 is received in the socket 964, a lower edge 965 of the socket 964 is disposed on an upper surface 967 of the nut 966. In this configuration, the upper surface 967 of the nut 966 may support a load applied to the toilet 902 and transfer the load to the extension 962 of the foot 960. The nut 966 may be threadably received on the extension 962, such that the height of the nut 966 above the floor 18 may be adjusted. According to another exemplary embodiment, the nut 966 may be permanently coupled to the extension 962 at a pre-determined height. According to yet another exemplary embodiment, the nut 966 may be a flange integrally formed with the extension 962. Various feet 960 may be provided with flanges at different pre-determined heights. A flange height may be selected from the feet 960, such that the discharge pipe outlet 926 is positioned at a desired height above the floor 18 corresponding with a height of the wall carrier 32 above the floor 18.

While FIG. 22 shows only one foot 960, according to other exemplary embodiments, more than one foot 960 may be used. The feet 960 may be used to adjust the level (e.g., pitch or roll) of the toilet. For example, a height of the nut 966 on a forward foot 960 may be adjusted, causing a forward end of the toilet 902 to rise or fall. Similarly, a height of the nut 966 on a rearward foot 960 may be adjusted, causing a rearward end of the toilet 902 to rise or fall.

Figure 23:
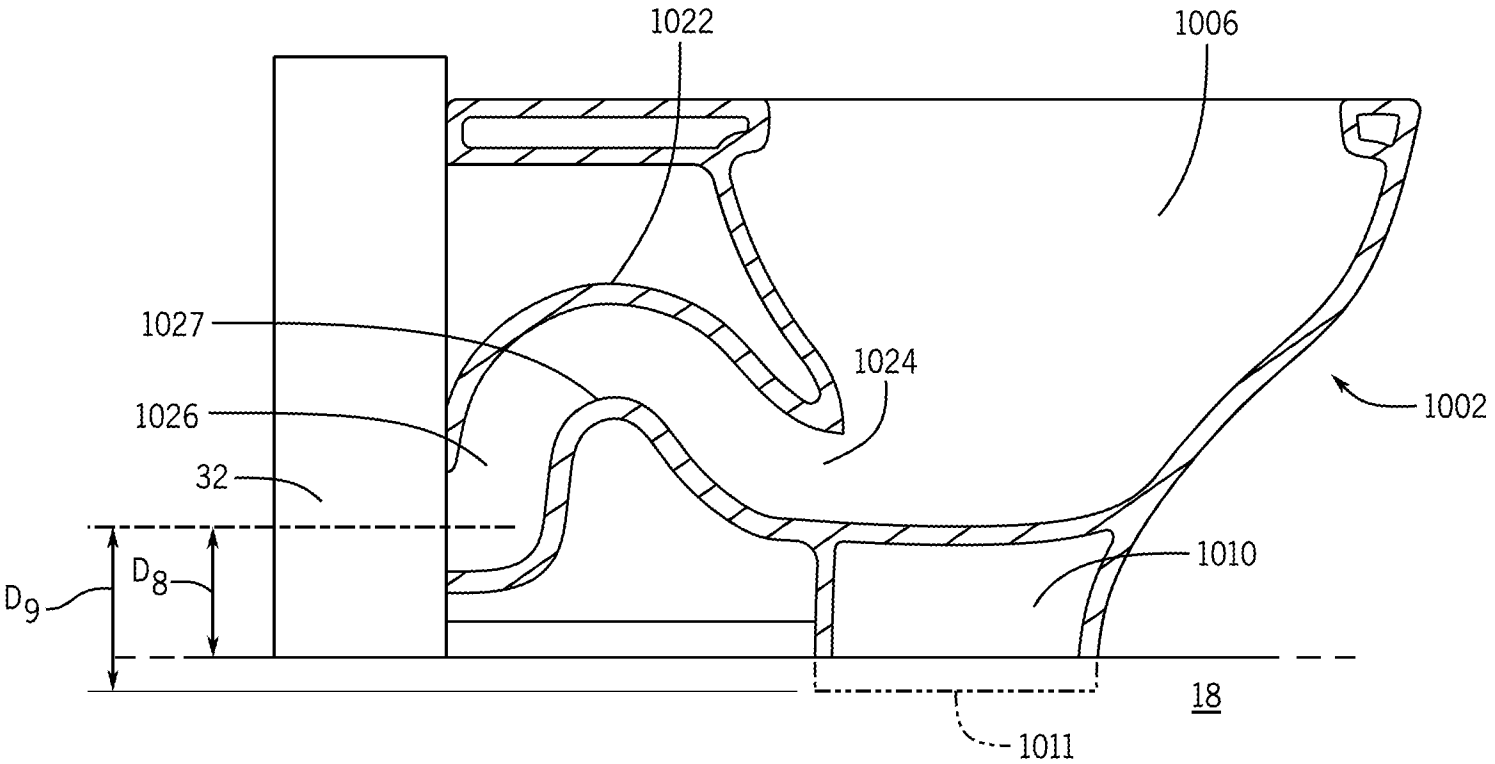
FIG. 23 is a side elevation view of an adjustable toilet according to an exemplary embodiment.

Referring now to FIG. 23, an adjustable toilet 1002 is shown according to an exemplary embodiment. The toilet 1002 is a floor-mounted (i.e., pedestal) toilet, including a base 1004 and a bowl 1006. The base 1004 is positioned, at least in part, below the bowl 1006 and is configured to support a load provided on the bowl 1006. A foot 1010 extends downward from the base 1004 and is configured to support the toilet 1002. A discharge pipe 1022 defines a discharge pipe inlet 1024 (i.e., inlet, first end, upstream end, etc.) and a discharge pipe outlet 1026 (i.e., outlet, second end, downstream end, etc.) at opposing ends thereof. The discharge pipe outlet 1026 may be disposed below the uppermost portion of the discharge pipe 1022, forming a weir 1027 between the discharge pipe inlet 1024 and the discharge pipe outlet 1026. As shown in FIG. 23, the discharge pipe outlet 1026 may be fluidly coupled to the wall carrier 32 for transferring waste from the toilet 1002. According to an exemplary embodiment, the discharge pipe 1022 may be integrally formed with the toilet 1002. According to another exemplary embodiment, the toilet 1002 may be substantially the same as the toilet 2 shown in FIGS. 1 and 2 and configured to house a trapway assembly, as discussed above.

The foot 1010 may be integrally formed with the base 1004, although according to other exemplary embodiments, the foot 1010 may be separately formed from the base 1004 and coupled thereto. The foot 1010 is elongate and formed having a length, such that the discharge pipe outlet 1026 is disposed above the wall carrier 32 when a lower end 1011 of the foot 1010 is disposed on the floor 18. The wall carrier 32 defines a central axis at a pre-determined height $D_8$ above the floor 18. A height $D_9$ is defined between a central axis of the discharge pipe outlet 1026 and the lower edge 1011 of the foot 1010. The initial length of the foot 1010 is provided, such that the height $D_9$ is greater than the height $D_8$. The foot 1010 is then shortened until the height $D_9$ is substantially the same as the height $D_8$, or such that the discharge pipe outlet 1026 may be fluidly coupled to the wall carrier 32 in combination with any of the foregoing trapway assemblies. For example, the foot 1010 may be shortened (i.e., cut, grinded, etc.) until the height $D_9$ results in the discharge pipe outlet 1026 being positioned at a desired position above the floor 18. In this configuration, when the foot 1010 is shortened, the lower edge 1011 thereof is redefined as closer to the bowl 1006. While FIG. 23 shows only one foot 1010, according to other exemplary embodiments, the toilet 1002 may include more than one foot 1010.

Figure 24:
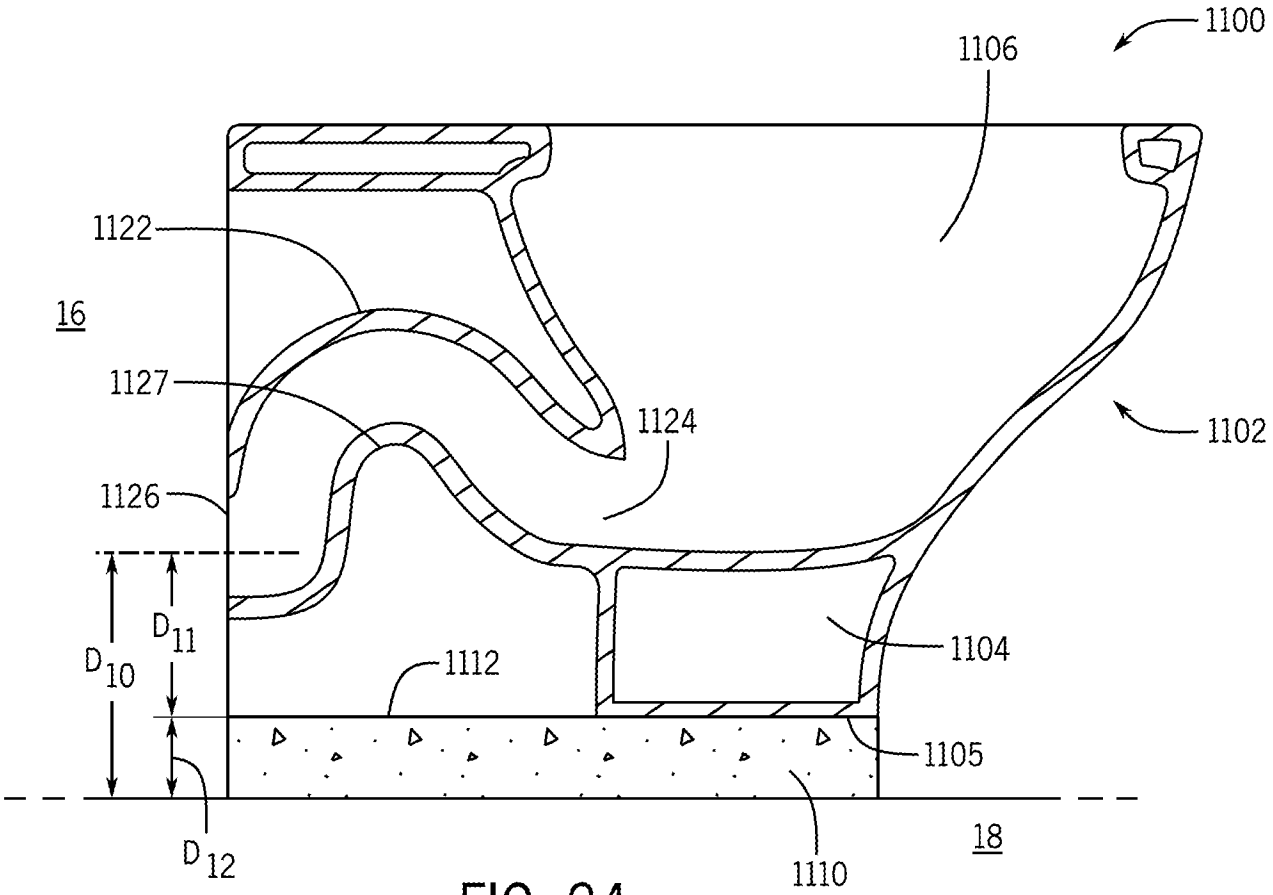
FIG. 24 is a side elevation view of an adjustable toilet assembly according to an exemplary embodiment.

Referring now to FIG. 24, an adjustable toilet assembly 1100 is shown according to an exemplary embodiment. The toilet assembly 1100 includes a toilet 1102, including a base 1104 and a bowl 1106. The base 1104 is positioned, at least in part, below the bowl 1106 and is configured to support a load provided on the bowl 1106. A platform 1110 is disposed below the base 1004 and is configured to support the toilet 1002. A discharge pipe 1122 defines a discharge pipe inlet 1124 (i.e., inlet, first end, upstream end, etc.) and a discharge pipe outlet 1126 (i.e., outlet, second end, downstream end, etc.) at opposing ends thereof. The discharge pipe outlet 1126 may be disposed below the uppermost portion of the discharge pipe 1122, forming a weir 1127 between the discharge pipe inlet 1124 and the discharge pipe outlet 1126. As shown in FIG. 24, the discharge pipe outlet 1126 may be fluidly coupled to the wall carrier 32 for transferring waste from the toilet 1102. According to an exemplary embodiment, the discharge pipe 1122 may be integrally formed with the toilet 1102. According to another exemplary embodiment, the toilet 1102 may be substantially the same as the toilet 2 shown in FIGS. 1 and 2 and configured to house a trapway assembly, as discussed above.

The platform 1110 may be formed from a compound, generating a hardened structure once the compound sets (i.e., cures). For example, a form may be formed at a desired location for the toilet 1102 in the bathroom and filled with the compound (e.g., a liquid compound), such that an upper surface 1112 of the platform 1110 is defined at a desired height above the floor 18. For example, after the compound hardens, the form is removed and the bottom edge 1105 of the base 1104 is disposed on the upper surface 1112 of the platform 1110. The compound may be any appropriate pourable material (e.g., cement, etc.) configured to harden and support the toilet 1102 thereon. The wall carrier 32 defines a central axis at a pre-determined (e.g., measured) height $D_{10}$ above the floor 18. A height $D_{11}$ is defined between a central axis of the discharge pipe outlet 1126 and the lower edge 1105 of the base 1104. The platform 1110 further defines a height $D_{12}$, such that the height $D_{11}$ of the discharge pipe outlet 1126 over the lower edge 1105 added to the height $D_{12}$ of the platform 1110 is substantially the same as the height $D_{10}$ of the wall carrier 32 or configured to be fluidly coupled to the wall carrier 32 in combination with any of the foregoing trapway assemblies. The form may be filled with the compound until the compound reaches the height $D_{12}$ within the form. According to another exemplary embodiment, where the compound expands or contracts while it sets, the compound may be filled in the form to another height, such that the platform has a height $D_{12}$ after the compound is set.

The toilet 1102 may be either a floor-mounted (i.e., pedestal) or a wall-mounted toilet. Because the compound sets over time, even where the toilet base 1104 does not have a flat lower edge 1105, the toilet 1102 may be positioned at an upper end of the form and the compound poured into the form, such that the compound fills in the space around the complex shape of the lower edge 1105. At least a portion of the base 1104 may be disposed below the upper surface 1112 of the platform 1110. In this configuration, the platform 1110 may define a shape having a complementary profile to the lower edge 1105 of the base 1104. Because the platform 1110 forms such a complementary profile to the lower edge 1105, the platform 1110 is configured to support either floor-mounted or wall-mounted toilets. According to other exemplary embodiments, the platform 1110 may define other shapes. While FIG. 24 shows only one platform 1110 supporting the base 1104 at substantially the entire lower edge 1105, according to other exemplary embodiments, the toilet assembly 1100 may include more than one platform 1110, each supporting the toilet 1102 at only a portion of the base 1104.

The platform 1110 may be provided with an appearance that is substantially the same as or different from the toilet 1102. According to an exemplary embodiment, it may be desirable to provide a specific finish to the platform 1110. For example, the platform 1110 may be provided with a desired texture (e.g., smoothed, patterned, etc.) while setting or may be finished (e.g., painted, epoxied, etc.) during or after setting. According to another exemplary embodiment, the platform 1110 may be concealed by a plurality of tiles or other structures, as described with respect to FIG. 21.

Figure 25:
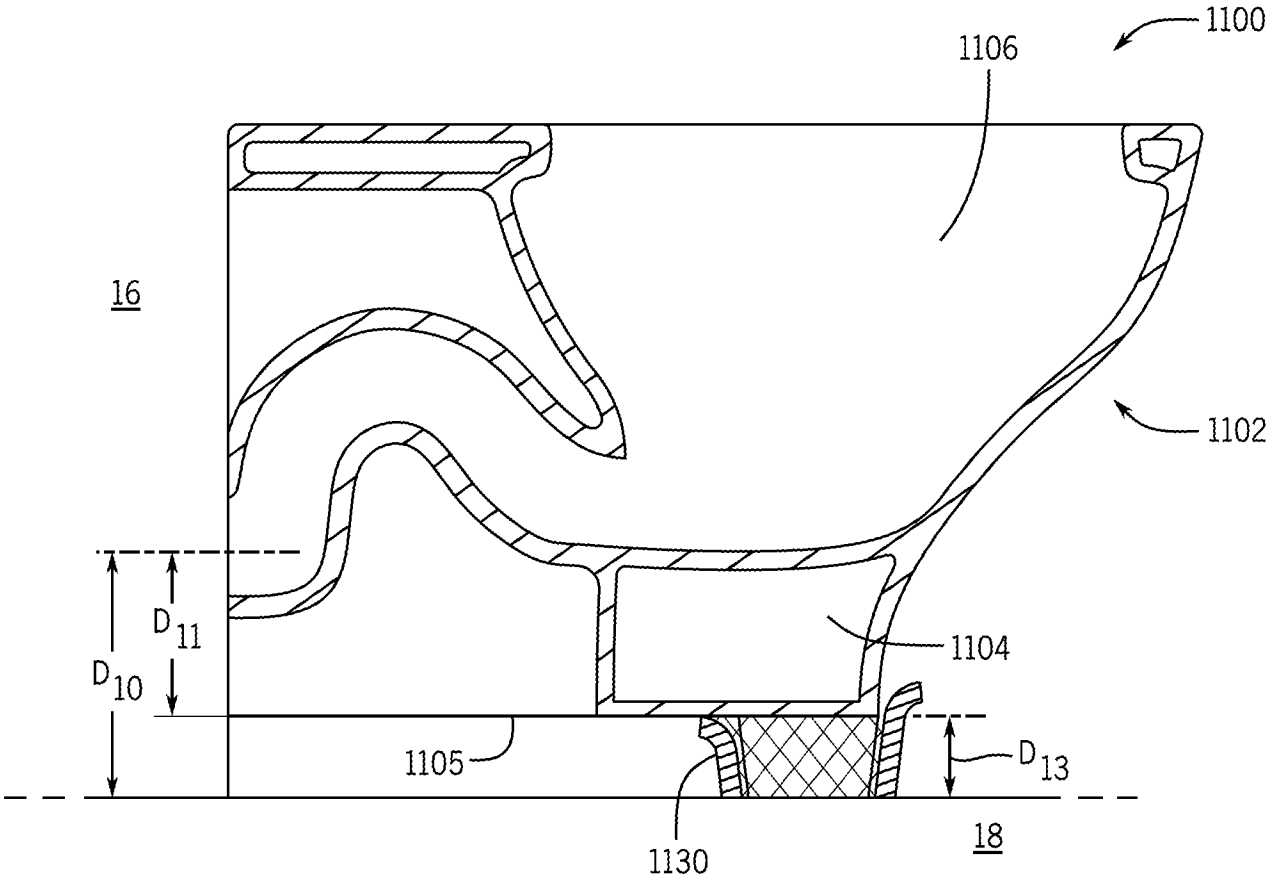
FIG. 25 is a side elevation view of an adjustable toilet assembly according to an exemplary embodiment.

Referring now to FIG. 25, the adjustable toilet assembly 1100 is shown according to another exemplary embodiment. The toilet assembly 1100 includes a form 1130 disposed between the lower edge 1105 of the base 1104 and the floor 18. The form 1130 is provided with a height $D_{13}$ greater than the height $D_{10}$ of the wall carrier less the height $D_{11}$ of the discharge pipe outlet 1126 over the lower edge 1105. The form 1130 is shortened (e.g., cut) until the height $D_{13}$ in addition to the height $D_{11}$ of the discharge pipe outlet 1126 over the lower edge 1105 is substantially the same as the height $D_{10}$ of the wall carrier 32 or configured to be fluidly coupled to the wall carrier 32 in combination with any of the foregoing trapway assemblies. The form 1130 is then positioned on the floor 18 and filled with a compound, similarly as described with respect to FIG. 24. In this configuration, the form 1130 may remain in place after the compound sets or may be removed.

One embodiment relates to a floor-mounted toilet, including a bowl defining a sump at a bottom end thereof and a discharge pipe defining a discharge pipe inlet disposed at the sump, and a discharge pipe outlet disposed at a height above the discharge pipe inlet. The toilet further includes a trapway assembly, including an upper trapway, defining an upper trapway inlet, an upper trapway outlet, and a passage formed therebetween, and a lower trapway, defining a lower trapway inlet, a lower trapway outlet, and a passage formed therebetween. The upper trapway inlet is configured to fluidly couple to the discharge pipe outlet. The lower trapway inlet is configured to adjustably receive the upper trapway outlet therein. The lower trapway outlet is configured to be fluidly coupled to a wall carrier.

In one aspect of the toilet, the upper trapway is positioned relative to the lower trapway, such that the upper trapway inlet is substantially aligned with the discharge pipe outlet.

In another aspect of the toilet, the passages of each of the upper and lower trapways are generally L-shaped.

In another aspect of the toilet, the toilet further includes a rear wall defining a cavity, the cavity configured to house the trapway assembly therein.

In another aspect of the toilet, the toilet further includes a plurality of elongated slots defined in a rear wall, each slot configured to receive a fastener for coupling the toilet to a wall.

In another aspect of the toilet, the slots are configured to align with mounting points positioned at varying heights above a floor.

In another aspect of the toilet, the toilet further includes a flange extending laterally from a rear portion of the upper trapway, the flange configured to engage a wall.

In another aspect of the toilet, the toilet further includes a mounting plate formed at the lower trapway outlet, the mounting plate configured to couple to a wall proximate to a wall carrier.

In another aspect of the toilet, the toilet further includes a wall carrier seal disposed between and configured to sealingly engage the mounting plate and the wall carrier.

In another aspect of the toilet, the upper trapway outlet and the lower trapway inlet are adjustably engaged in a telescoping relationship, and an O-ring is sealingly disposed between the upper trapway outlet and the lower trapway inlet.

In another aspect of the toilet, the toilet further includes a seal disposed between and configured to sealingly engage the discharge pipe outlet and the upper trapway inlet.

In another aspect of the toilet, the discharge pipe outlet is at an uppermost portion of the discharge pipe.

Another embodiment relates to a floor-mounted toilet, including a bowl defining a sump at a bottom end thereof and a discharge pipe defining a discharge pipe inlet disposed at the sump, and a discharge pipe outlet disposed at a height above the discharge pipe inlet. The toilet further includes a trapway assembly, including an upper trapway, defining an upper trapway inlet, an upper trapway outlet, and a passage formed therebetween, and a lower trapway, defining a lower trapway inlet, a lower trapway outlet, and a passage formed therebetween. The upper trapway inlet is fluidly coupled to the discharge pipe outlet. The lower trapway inlet is adjustably received in the upper trapway outlet. The lower trapway outlet is fluidly coupled to a wall carrier.

In one aspect of the toilet, the toilet further includes a wall defining a plurality of mounting points. The plurality of mounting points are configured to support a wall-mounted toilet.

In another aspect of the toilet, the toilet further includes a rear wall defining a plurality of elongated slots, and at least one fastener extending through each slot and threadably received in a corresponding mounting point for securing the toilet to the wall.

In another aspect of the toilet, the toilet further includes a mounting plate formed at the lower trapway outlet, the mounting plate configured to couple to a wall proximate to a wall carrier. The mounting plate is coupled to the wall at the plurality of mounting points.

In another aspect of the toilet, the toilet further includes a flange extending laterally from a rear portion of the upper trapway, and a seal disposed between the discharge pipe outlet and the upper trapway inlet. The seal is compressed when the flange and the toilet engage a wall.

Another embodiment relates a method of providing a floor-mounted toilet for use with a wall carrier, including inserting an outlet of an upper trapway in an inlet of a lower trapway, and positioning an outlet of the lower trapway such that the outlet of the lower trapway is configured to be aligned with a wall carrier disposed in a wall. The method further includes positioning a mounting plate such that the mounting plate is configured to be coupled to the wall, the mounting plate disposed proximate the outlet of the lower trapway. The method further includes adjusting a position of the upper trapway within the inlet of the lower trapway, such that an inlet of the upper trapway is configured to be substantially aligned with an outlet of a discharge pipe of the floor-mounted toilet. The method further includes fluidly coupling the outlet of the discharge pipe and the inlet of the upper trapway.

In one aspect of the method, the method further includes compressing a seal disposed between the outlet of the discharge pipe and the inlet of the upper trapway by fastening a rear wall of the toilet to the wall.

In another aspect of the method, the method further includes compressing a wall carrier seal disposed between the outlet of the lower trapway and the wall carrier by fastening the mounting plate to the wall.

Another embodiment relates to a floor-mounted toilet, including a bowl defining a sump at a bottom end thereof and a discharge pipe defining a discharge pipe inlet disposed at the sump, and a discharge pipe outlet disposed at a height above the discharge pipe inlet and below an upper peak of the discharge pipe. The toilet further includes a lower trapway, defining a lower trapway inlet, a lower trapway outlet, and a passage formed therebetween. The lower trapway inlet is configured to fluidly couple to the discharge pipe outlet. The lower trapway outlet is configured to be fluidly coupled to a wall carrier.

In one aspect of the toilet, the discharge pipe outlet defines an axis extending substantially vertically.

In another aspect of the toilet, the toilet further includes a gasket disposed between and configured to sealingly engage the discharge pipe and the lower trapway.

For purposes of this application, the terms "front," "forward," and the like refer to a portion of the toilet 2 away from the wall 16 when the toilet 2 is installed thereon. The terms "rear," "rearward," and the like refer to a portion of the toilet proximate the wall 16 when the toilet 2 is installed thereon. According to other exemplary embodiments, the toilet 2 may have other orientations relative to the wall 16.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of this disclosure as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the position of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is to be understood that although the present invention has been described with regard to preferred embodiments thereof, various other embodiments and variants may occur to those skilled in the art, which are within the scope and spirit of the invention, and such other embodiments and variants are intended to be covered by corresponding claims. Those skilled in the art will readily appreciate that many modifications are possible (e.g., variations in sizes, dimensions, structures, shapes and proportions of the various elements, mounting arrangements, use of materials, orientations, manufacturing processes, etc.) without materially departing from the novel teachings and advantages of the subject matter described herein. For example, the order or sequence of any process or method steps may be varied or re-sequenced according to alternative embodiments. Other substitutions, modifications, changes and omissions may also be made in the design, operating conditions and arrangement of the various exemplary embodiments without departing from the scope of the present disclosure.

What is claimed is:

1. A toilet, comprising:

a base comprising a lower surface configured to engage a floor in a bathroom, the base defining a rear wall;

a plurality of openings defined in the rear wall configured to couple the rear wall to a wall carrier configured to be disposed on a bathroom wall;

a cavity formed in the rear wall;

a bowl defining a sump;

a discharge pipe defining a discharge pipe inlet disposed at the sump and a discharge pipe outlet disposed in the cavity; and a trapway assembly includes an upper trapway configured to be fluidly connected to the discharge pipe outlet and a lower trapway, the lower trapway comprising:

a lower trapway outlet configured to be fluidly coupled to the wall carrier configured to be disposed on the bathroom wall; and a mounting plate formed at the lower trapway outlet, the mounting plate comprising an annular groove configured to receive the wall carrier therein;

wherein the trapway assembly is adjustable to increase and/or decrease height of the upper trapway in a vertical direction relative to each of the discharge pipe outlet and the lower surface of the base such that, in a first installation configuration, the lower trapway is configured to be coupled to the wall carrier at a first height relative to the floor, and to be coupled to the wall carrier at a second height relative to the floor that is different from the first height, in a second installation configuration; and wherein a height of the discharge pipe outlet relative to the floor is the same in each of the first installation configuration and the second installation configuration.

2. The toilet according to claim 1, wherein the discharge pipe outlet defines a substantially vertical axis.

3. The toilet according to claim 1, wherein the discharge pipe outlet is adjustably received in the upper trapway.

4. The toilet according to claim 1, further comprising a gasket disposed annularly about the discharge pipe proximate the discharge pipe outlet;

wherein the gasket is compressed between and sealingly engages the discharge pipe and the upper trapway.

5. The toilet according to claim 1, wherein the cavity is configured to conceal the discharge pipe outlet and the lower trapway from view when the rear wall is disposed against a wall in a bathroom.

6. The toilet according to claim 1, further comprising a wall carrier seal received in the annular groove and disposed between and configured to sealingly engage the mounting plate and the wall carrier.

7. The toilet according to claim 6, wherein the wall carrier seal is compressed between the mounting plate and the wall carrier when the rear wall of the base is coupled to the wall carrier.

8. The toilet according to claim 1, wherein the plurality of openings are a plurality of vertically elongated slots.

9. The toilet according to claim 1, wherein the rear wall is coupled directly to at least one of the wall in the bathroom or the wall carrier.

10. The toilet according to claim 1, wherein both of the rear wall and the lower trapway are coupled directly to the wall carrier.

11. A toilet, comprising:

a base comprising a lower surface configured to engage a bathroom floor, the base defining a rear wall;

a plurality of vertically elongated openings defined in the rear wall configured to couple the rear wall to a wall carrier configured to be disposed on a bathroom wall, wherein each opening is accessible from within an interior of a bathroom when the base is positioned along the bathroom wall and is configured to receive a fastener at a plurality of heights relative to the bathroom floor;

a cavity formed in the rear wall;

a bowl defining a sump;

a discharge pipe defining a discharge pipe inlet disposed at the sump and a discharge pipe outlet disposed in the cavity; and a trapway assembly including an upper trapway configured to be fluidly connected to the discharge pipe outlet and a lower trapway, the lower trapway comprising:

a lower trapway outlet configured to be fluidly coupled to the wall carrier configured to be disposed on the bathroom wall; and a mounting plate formed at the lower trapway outlet, the mounting plate comprising an annular groove configured to receive the wall carrier therein;

wherein the trapway assembly is adjustable to vary the relative position of the upper trapway with respect to the lower trapway so that the lower trapway outlet is configured to be coupled to the wall carrier and is vertically offset from the lower surface of the base by a first distance when the lower trapway is in a first installation configuration, and is vertically offset from the lower surface of the base by a second distance, different than the first distance, when the lower trapway is in a second installation configuration.

12. The toilet according to claim 11, wherein the interaction between the base and the bathroom floor is configured to support a load of a user sitting on the toilet assembly.

13. The toilet according to claim 11, wherein the bathroom wall defines a plurality of mounting points configured to support a wall-mounted toilet; and wherein the rear wall is coupled to the bathroom wall with a plurality of fasteners extending through the plurality of openings and the plurality of mounting points.

14. The toilet according to claim 11, further comprising a wall carrier seal received in the annular groove and disposed between and configured to sealingly engage the mounting plate and the wall carrier.

15. The toilet according to claim 14, wherein the wall carrier seal is compressed between the mounting plate and the wall carrier when the rear wall is coupled to the bathroom wall.

16. A method of providing a floor-mounted toilet for use with a wall carrier, comprising:

providing a trapway assembly comprising an upper trapway and a lower trapway having a lower trapway outlet at a downstream end, and a mounting plate extending outward at the lower trapway outlet, the mounting plate comprising an annular groove configured to receive a wall carrier therein;

positioning the lower trapway outlet proximate the wall carrier;

coupling the mounting plate to the wall carrier by receiving the wall carrier in the annular groove;

providing a floor-mounted toilet with a discharge pipe having a discharge pipe outlet disposed in a cavity formed in a rear wall of the toilet;

lowering the discharge pipe outlet into the upper trapway, wherein the relative position of the upper trapway with respect to the lower trapway is variable; and coupling the rear wall of the toilet to the bathroom wall using a fastener inserted into an elongated opening defined within a front surface of the rear wall and towards the bathroom wall;

wherein the lower trapway is supported entirely independent of the floor of the bathroom via the coupling of the mounting plate to the wall carrier wherein the elongated opening is configured to allow the fastener to be inserted into the front surface of the rear wall and towards the rear surface of the rear wall when the base is positioned against the bathroom wall.

17. The method according to claim 16, wherein the mounting plate and the rear wall are coupled to the bathroom wall at mounting points configured to support a wall-mounted toilet.

18. The method according to claim 16, further comprising compressing a wall carrier seal between the wall carrier and the mounting plate and receiving the wall carrier seal in in the annular groove.

19. The method according to claim 16, further comprising:

providing a gasket disposed annularly about the discharge pipe proximate the discharge pipe outlet; and compressing the gasket between the discharge pipe outlet and the upper trapway.

* * * * *